US005292573A

United States Patent [19]

Adams, Jr. et al.

[11] Patent Number: 5,292,573

[45] Date of Patent: Mar. 8, 1994

[54] METHOD FOR GENERATING A CONDUCTIVE FABRIC AND ASSOCIATED PRODUCT

[75] Inventors: Louis W. Adams, Jr., Spartanburg; Michael W. Gilpatrick, Chesnee; Richard V. Gregory, Anderson, all of S.C.

[73] Assignee: Milliken Research Corporation, Spartanburg, S.C.

[21] Appl. No.: 833,605

[22] Filed: Feb. 11, 1992

Related U.S. Application Data

[63] Continuation-in-part of Ser. No. 448,035, Dec. 8, 1989, abandoned.

[51] Int. Cl.[5] ..... B05D 5/00

[52] U.S. Cl. ..... 428/196; 28/104; 28/105; 28/168; 428/197; 428/253

[58] Field of Search ..... 28/168, 104, 105; 428/196, 197, 253

[56] References Cited

U.S. PATENT DOCUMENTS

| | | | |
|---|---|---|---|
| 3,909,195 | 9/1975 | Machell et al. | 8/115.7 |
| 3,950,589 | 4/1976 | Togo et al. | 428/395 |
| 4,877,646 | 10/1989 | Kuhn et al. | 427/121 |
| 4,975,317 | 12/1990 | Kuhn et al. | 428/253 |
| 5,066,535 | 11/1991 | Christie et al. | 428/196 |
| 5,162,135 | 11/1992 | Gregory et al. | 428/196 |

*Primary Examiner*—James J. Bell

*Attorney, Agent, or Firm*—Kevin M. Kercher; Terry T. Moyer

[57] ABSTRACT

An electrically conductive textile fabric in which the electrical conductivity may be made to vary in a pattern configuration, and a method for manufacturing such fabric. A textile fabric is coated with an electrically conductive polymeric coating, and the coating is selectively removed in those areas in which a reduced electrical conductivity is desired. The removal may be achieved by means of high velocity water jets, sculpturing, or other means.

30 Claims, 12 Drawing Sheets

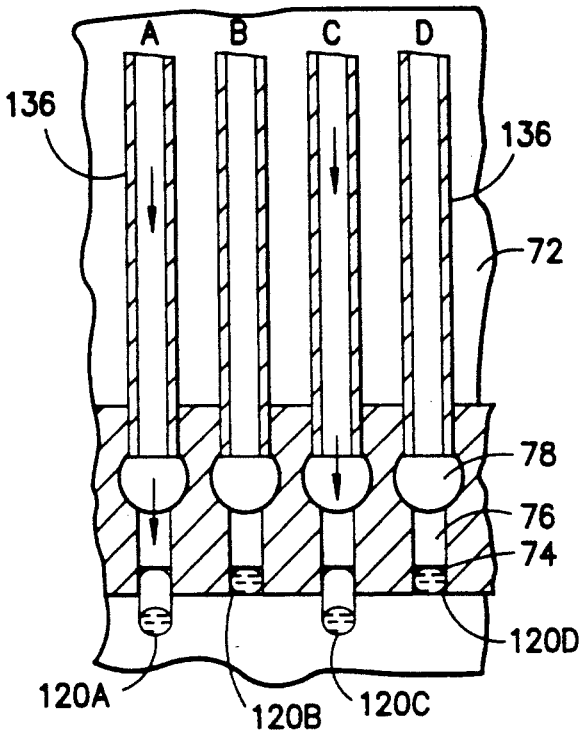
*FIG. –16–*

METHOD FOR GENERATING A CONDUCTIVE FABRIC AND ASSOCIATED PRODUCT

CROSS-REFERENCE TO RELATED APPLICATIONS

This application is a continuation-in-part of U.S. patent application Ser. No. 07/448,035 filed Dec. 8, 1989, now abandoned.

This invention relates to textile fabrics comprised of fibers, filaments, or yarns which carry an electrically conductive polymeric coating. In particular, this invention, in a preferred embodiment, relates to a textile fabric in which the electrically conductive polymeric coating is non-uniform, resulting in a fabric exhibiting anisotropic electrical resistance or impedance, and a method for making such fabrics.

Electrically conductive fabrics are well known, and may be made by a variety of published methods. For example, synthetic fibers comprising the fabric may be manufactured by mixing or blending a conductive powder, such as carbon black or particles of a metallic conductor, with the polymer melt prior to extrusion of the fibers. However, it is also known that when conductive fibers are made in this fashion, the amount of powder or filler required for the desired degree of conductivity may be so high as to adversely affect the non-electrical properties of the fibers and resulting fabric.

Alternatively, the fabric, or certain yarns comprising the fabric, may be coated with an electrically conductive metallic coating containing silver, copper, or the like. Such products, however, tend to be difficult to manufacture and, consequently, are relatively expensive. Furthermore, because of their physical properties, the resulting products are often difficult to customize to a particular end use. Such fabrics are accordingly found only in rather specialized end uses where their cost and physical properties are acceptable.

Recently, an electrically conductive polymeric coating for textile substrates has been developed which is capable of imparting relatively high electrical conductivity to such substrates. This coating, and fabrics employing such coating, are more fully disclosed, for example, in commonly assigned U.S. Pat. No. 4,803,096 to Kuhn, et al., which patent is hereby incorporated by reference herein. In Kuhn, et al., an ordered conductive polymeric coating containing a pyrrole or aniline compound is used to cover, by means of epitaxial deposition, the constituent fibers of a fabric. The resulting fabric exhibits significant electrical conductivity which generally may range from about 50 to about 500,000 ohms per square. The "per square" measurement of conductivity involves determining the average conductivity across the major axis (i.e., between both) pairs of opposite edges of a square of fabric (using electrodes which extend along the entire respective edges). See Kuhn, et al. for further details.

In many end uses, however, it is desirable to be able to vary the conductivity of the fabric surface in various directions. Among the end uses where such selective and/or directional electrical conductivity may be advantageous includes the control of static electricity, the shielding from or absorption of electromagnetic energy, and the generation of localized heat by means of resistance heating. It should be understood that, although the term conductivity is used throughout, the substrates disclosed herein also exhibit selective and/or directional impedance. Other applications involving the distribution or dispersal of electrical or electromagnetic energy by an anisotropic electrically conductive fabric will become apparent to those skilled in the art.

It has been discovered that a high velocity stream or jet of water, when directed onto an appropriate fabric carrying the conductive coating disclosed herein, is capable of displacing or removing the coating to the extent necessary to affect drastically the surface electrical conductivity of the fabric, without significantly affecting the integrity of the fabric, i.e., without substantially degrading the fabric's strength. It is believed that portions of the coating are in fact removed entirely from the fabric by the action of the water jets. Even though it is possible that displacement also plays a role, the term removal shall be used hereinafter, with the understanding that displacement is also intended to the extent applicable. The term fiber, yarn, and filament shall be used interchangeably to mean the individual constituent textile elements from which the textile fabrics discussed herein are constructed. It has further been discovered that, when such method is used on a woven fabric, the degree to which the conductivity is affected is directional, i.e., the maximum decrease in conductivity (indicating the maximum removal of the conductive coating) depends upon the relative direction in which the fabric is passed through the water jet. If a woven fabric is passed through the water jet in the warp direction (i.e., parallel to the direction of its warp yarns), the coating is preferentially removed from the warp yarns, yielding a significantly reduced conductivity in the warp direction, with a much smaller change in the surface conductivity in the fabric fill direction. The fabrics of this invention are first coated with an electrically conductive polymeric coating of the kind disclosed hereinbelow. The resulting individual fabric samples exhibit substantially uniform surface electrical conductivity characteristics, which are determined by the conditions under which the coating on a given sample fabric is formed, as well as the nature of the fabric. The resulting coated fabrics may have a conductivity value which varies (from case to case) from about 20 or 30 ohms per square to values approaching 500,000 ohms per square or more. The particular coatings which exhibit conductivities below about 50 ohms per square are the inventions of others, and are not intended to be a part of the invention claimed herein.

It should be noted that, even prior to such treatment, a coated fabric which exhibits "uniform" conductivity (as measured on a per square basis) may exhibit a directional conductivity due to the inherent construction characteristics of the fabric to which the coating was uniformly applied. For example, if a woven fabric has substantially more fiber mass in the warp direction than in the fill direction (e.g., due to a greater number of warp direction fibers, or a larger warp fiber diameter or greater warp fiber length), or has a greater surface area of constituent filaments comprising the warp compared with fill yarns, then coating the fabric will usually result in more of the conductive coating being associated with yarns extending in the warp direction. The resulting fabric will therefore generally exhibit greater conductivity in the warp direction. Correspondingly, other than woven fabrics may have construction characteristics which, following a uniform application of a conductive coating, will result in a similar uniform "per square" conductivity over the fabric surface, but which will include a clearly directional conductivity characteristic. For example, warp knit fabrics, with a relatively large number of yarns extending in the warp direction, can be generally expected to exhibit higher conductivity in the warp direction than in the fill direction. Non-woven fabrics in which the constituent fibers or filaments are uniformly distributed in a random orientation can be considered an example of a fabric which, when coated uniformly, would probably yield a conductivity which would not be appreciably directional, at least over significant distances on the fabric surface.

In accordance with the present invention, the fabric carrying such coating may then be treated to remove a portion of the coating, resulting in an area of the fabric wherein the surface electrical conductivity is substantially lower in at least one direction than those areas in which the coating is substantially intact. A preferred method for achieving removal of the coating is by directing high velocity water jets to the fabric as the fabric is being supported by a solid backing member.

Further details of both the coating process and the preferred coating removal process are contained in the following detailed description, as well as the accompanying drawings, in which.

Figure 6A:
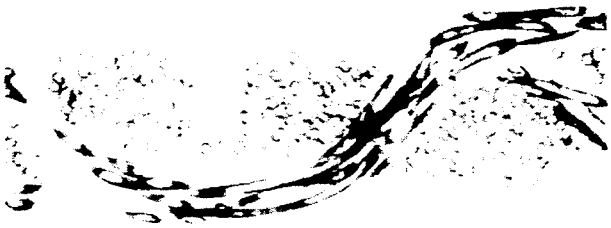
Figure 6B:
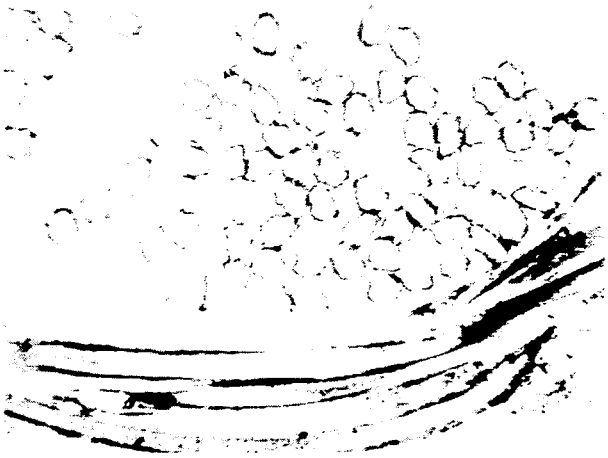
Figure 6C:
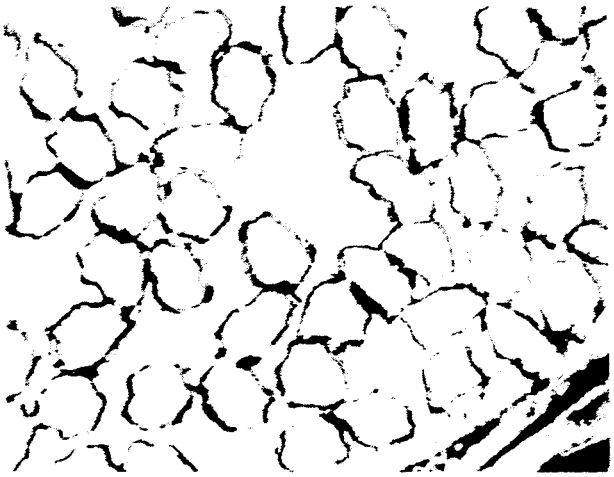
Figure 7A:
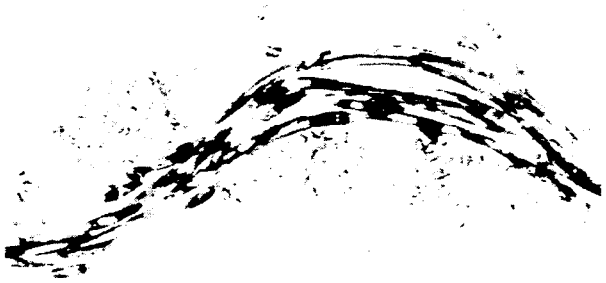
Figure 7B:
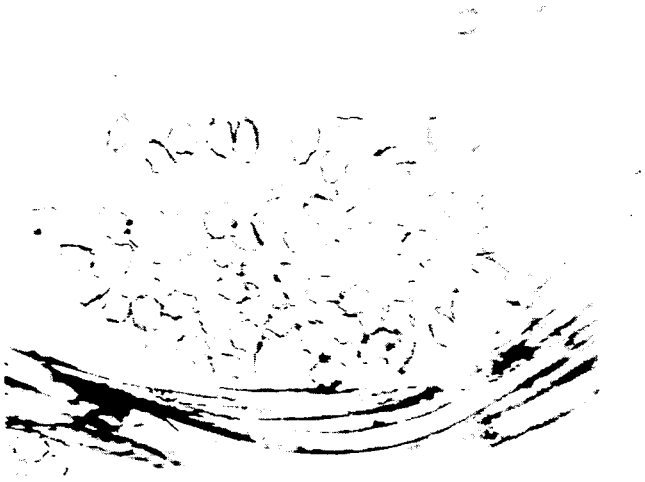
Figure 7C:
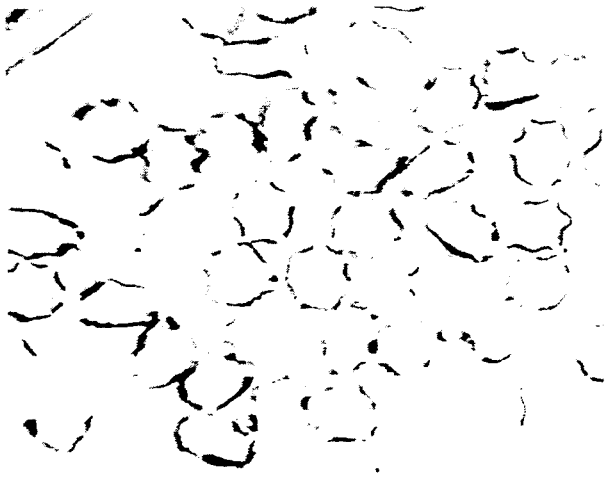
Figure 8A:
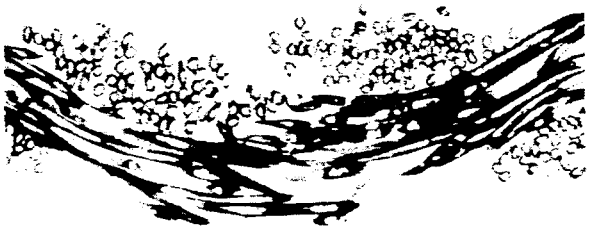
Figure 8B:
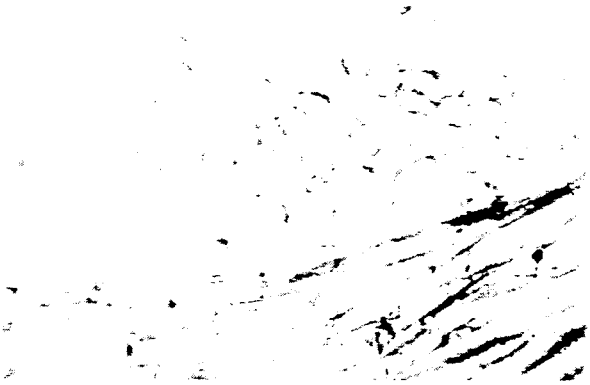
Figure 8C:
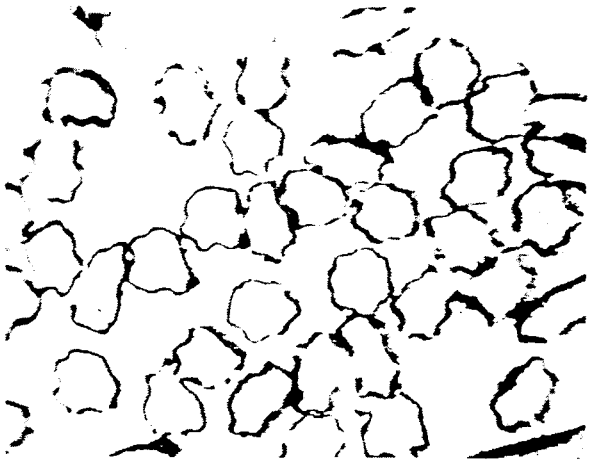
Figure 9A:
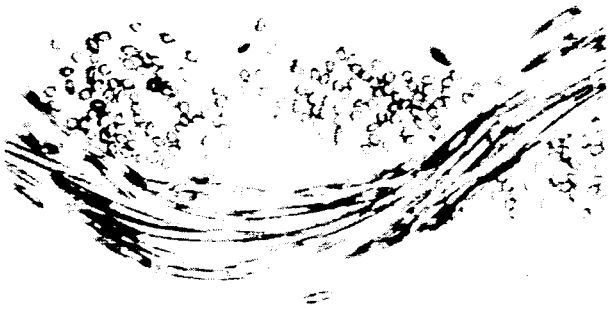
Figure 9B:
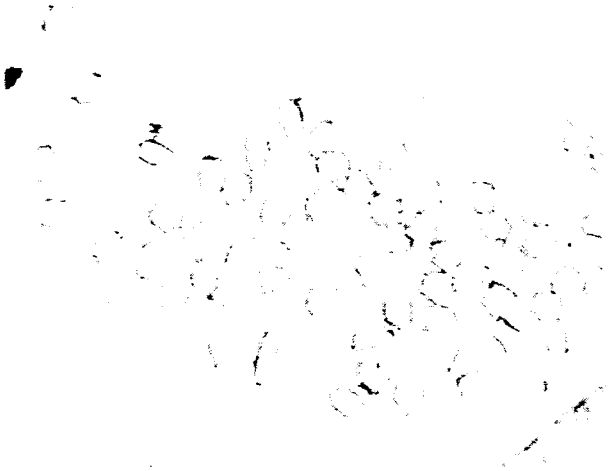
Figure 9C:
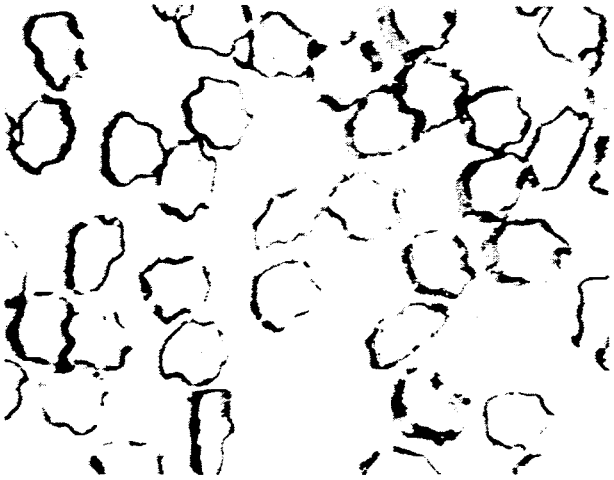
Figure 10:
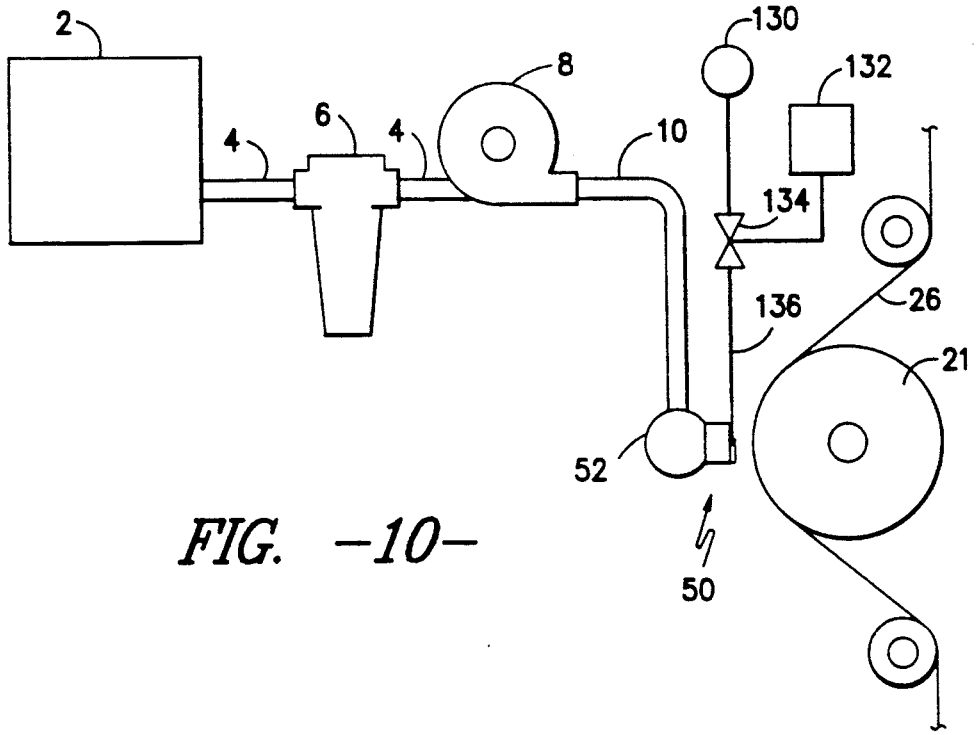
Figure 11:
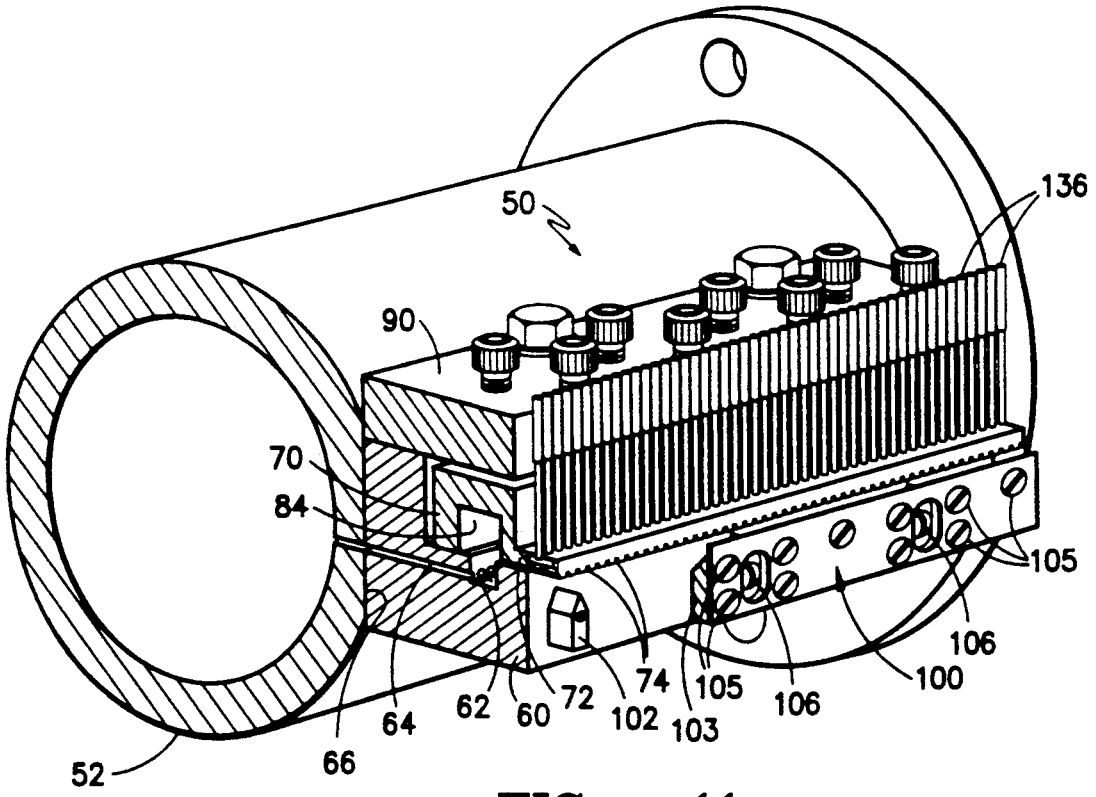
Figure 12:
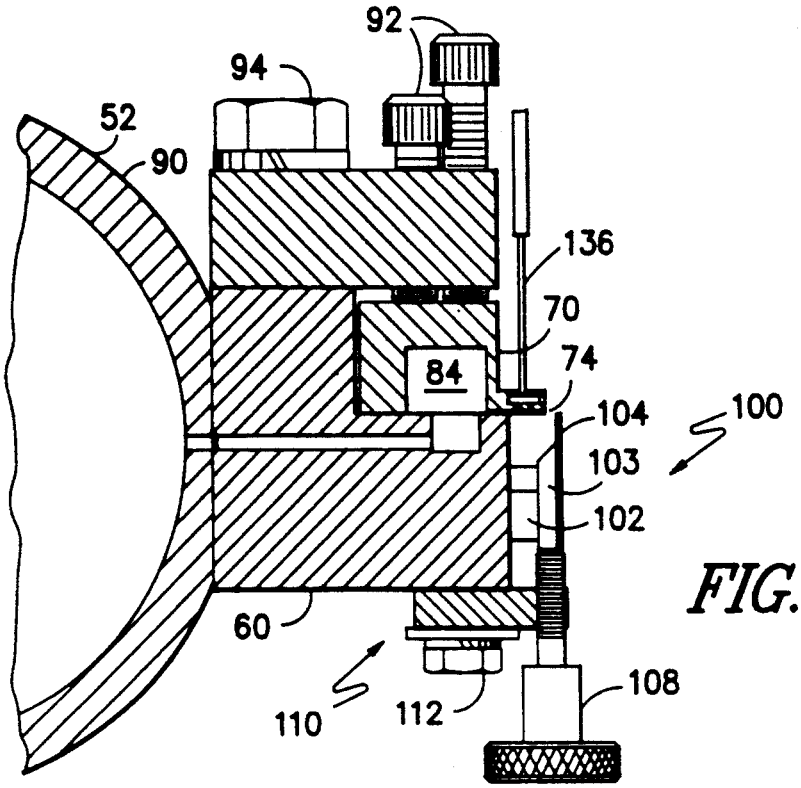
Figure 13:
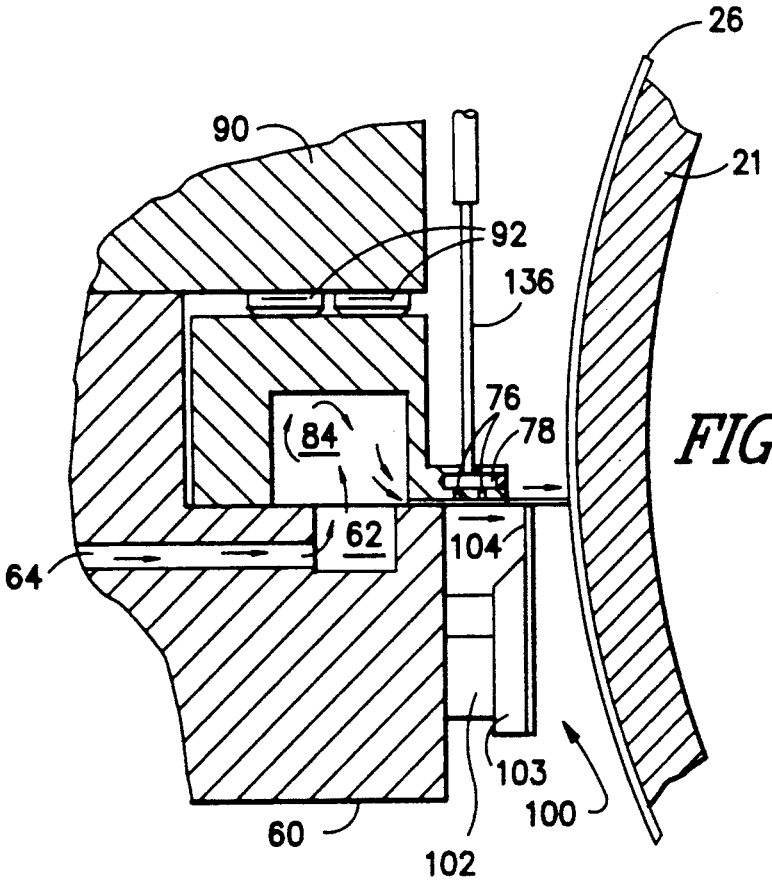
Figure 14:
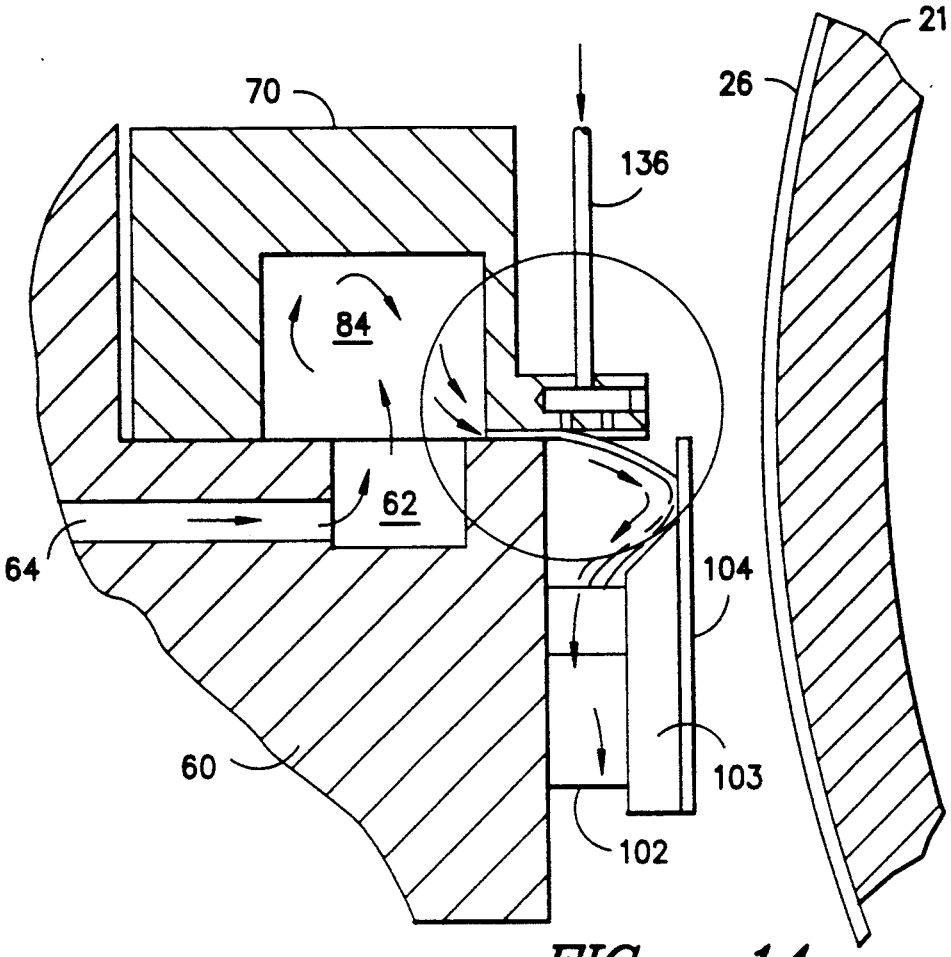
Figure 15:
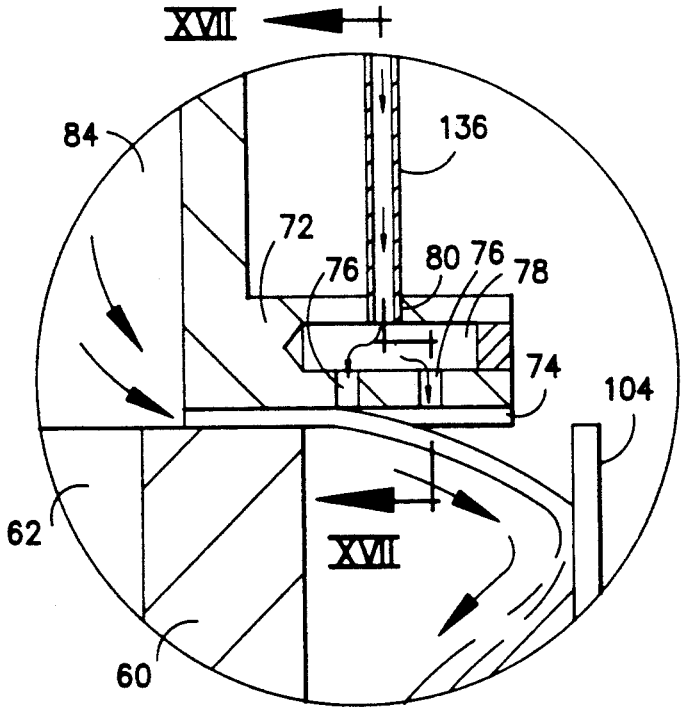

FIGS. 6A, 6B, and 6C are light photomicrographs at respective powers of 70X, 210X, and 430X, showing a cross section taken in the fill direction (i.e., warp yarns viewed end-on) of a coated but untreated woven fabric sample coating;

FIGS. 7A, 7B, and 7C are light photomicrographs, corresponding to those in FIGS. 6A through 6C, showing the results of treatment using a high velocity water jet apparatus as disclosed herein;

FIGS. 8A, 8B, and 8C are light photomicrographs at respective powers of 70X, 210X, and 430X, showing a cross section taken in the warp direction (i.e., fill yarns viewed end-on) of a coated but untreated woven fabric sample;

FIGS. 9A, 9B, and 9C are light photomicrographs, corresponding to those in FIGS. 8A through 8C, showing the results of treatment using a high velocity water jet apparatus as disclosed herein;

FIG. 10 is an overview of one apparatus which can be used to remove the conductive coating from the textile substrates discussed herein;

FIG. 11 is a perspective view of the high pressure manifold assembly depicted in FIG. 10;

FIG. 12 is a side view of the assembly of FIG. 11;

FIG. 13 is a cross-section view of the assembly of FIG. 11, showing the path of the high velocity fluid through the manifold, and the path of the resulting fluid stream as it strikes a substrate placed against the support roll;

FIG. 14 depicts a portion of the view of FIG. 13, but wherein the fluid stream is prevented from striking the target substrate by the deflecting action of a stream of control fluid;

FIG. 15 is an enlarged, cross-section view of the encircled portion of FIG. 14;

FIG. 16 is a cross-section view taken along lines XVI—XVI of FIG. 15, depicting the deflection of selected working fluid jets by the flow of control fluid.

Figure 1:
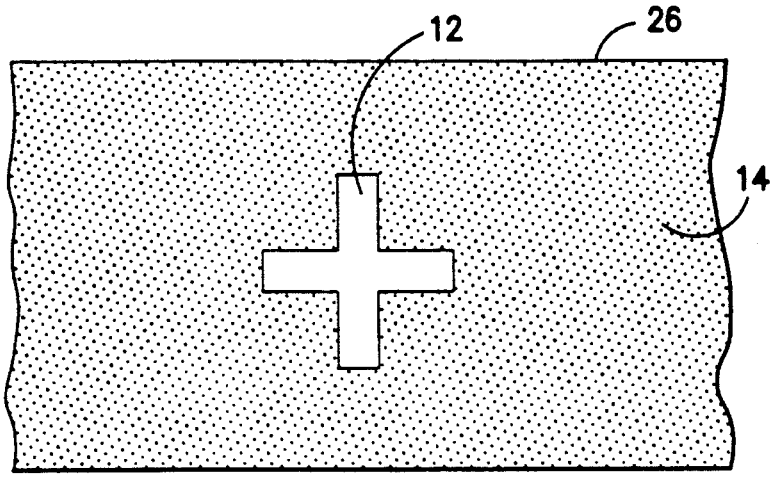
FIG. 1 is a diagrammatic view of a textile fabric which has been coated with a conductive polymer of the kind disclosed hereinbelow, wherein a cross-shaped portion of the conductive coating has been removed in a pattern configuration.

As can be seen in FIG. 1, the present invention makes possible a fabric which carries a conductive coating substantially intact in areas where relatively high electrical surface conductivity is desired, and areas where the coating has been at least partially removed and relatively low surface conductivity is desired. Cross 12 is the area on textile fabric 26 where a conductive polymer coating has been removed, e.g., by means of contact with high velocity water jets as disclosed hereinbelow. Background area 14 has been left undisturbed. If fabric 26 is woven, treatment by water jets as disclosed herein will result in the conductive coating being removed preferentially from yarns parallel to the direction of substrate travel through the machine. Accordingly, if fabric 26 is woven and is passed through the water jets in the warp direction, more coating will be displaced from the warp yarns, resulting in a substantially lower conductivity in the warp direction within cross 12, as compared with the fill direction within cross 12 (assuming little or no initial conductivity directionality prior to treatment). It is a characteristic of this process that the coating is preferentially (but not exclusively) removed from those fibers which form the exposed surface portions of the fabric surface.

Figure 2:
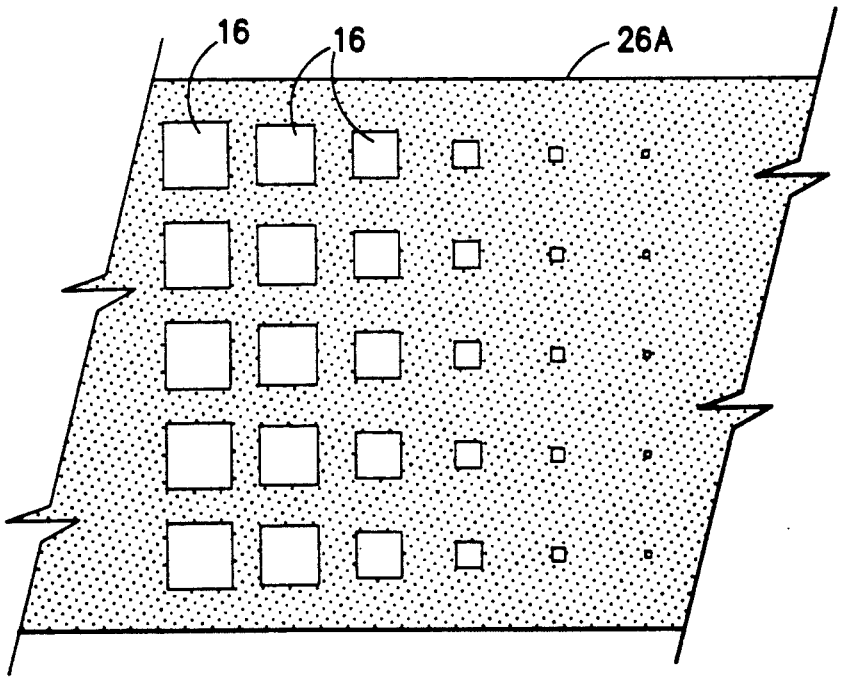
FIG. 2 is a diagrammatic view of a coated fabric where the conductive coating has been selectively removed in a repeating geometrical shape of decreasing size, thereby forming a pattern in which the unit electrical conductivity of the fabric varies along its length (i.e., left to right)
Figure 3:
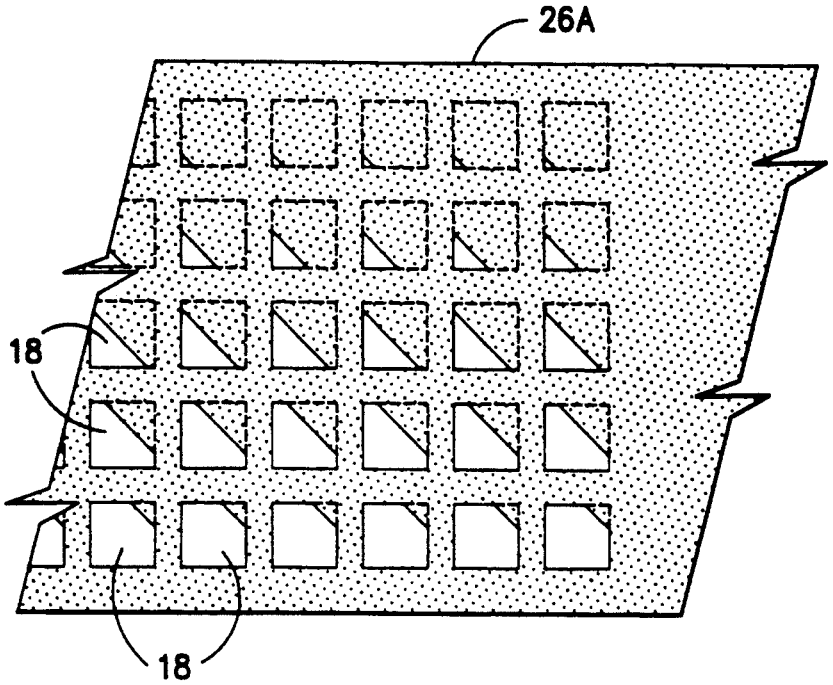
FIG. 3 is a diagrammatic view of a coated fabric in which the conductive coating has been selectively removed in a repeating geometrical pattern which provides for a change in conductivity across the width of the fabric (i.e., in an up and down direction, as shown)

In FIGS. 2 and 3, the conductive polymeric coating on fabric 26A has been at least partially removed in the areas indicated at 16 and 18, respectively, resulting in reduced electrical conductivity in those areas, at least in certain directions. The fabric shown in FIG. 2 will have an average, per square conductivity gradient, the conductivity increasing from left to right. In FIG. 3, a gradient of decreasing average, per square conductivity extends from top to bottom. It should be understood that within each treated area 16,18, the conductivity may also exhibit a directional nature if the fabric is woven and the coating removal technique is the water jet treatment discussed herein. Therefore, the fabric may exhibit both local and overall anisotropy (i.e., directional conductivity).

As discussed above, if the fabric 26A of FIGS. 2 and 3 is a woven fabric and the coating displacement technique uses high velocity water jets as disclosed herein, then the decrease in electrical conductivity of the fabric within each of the treated square areas will be greater in the same direction in which the jets moved over the fabric, than in the transverse direction. It is believed the direction characteristics with respect to warp and fill directions is due at least in part to a tendency for the woven fabric yarns which are transverse to the direction of fabric travel to "flip" quickly through the direct path of the jets, while the yarns parallel to the direction of fabric travel cannot move (which would thereby reduce their exposure to the jets), and so receive more extended exposure to the jets. By turning the fabric ninety degrees and moving the fabric through the apparatus so the jets travel along the fabric in the fill direction, the conductive coating can be removed preferentially in the fill direction, resulting in a fabric which, if previously isotropic in conductivity, will be more electrically conductive in the warp direction than in the fill direction.

Figure 4:
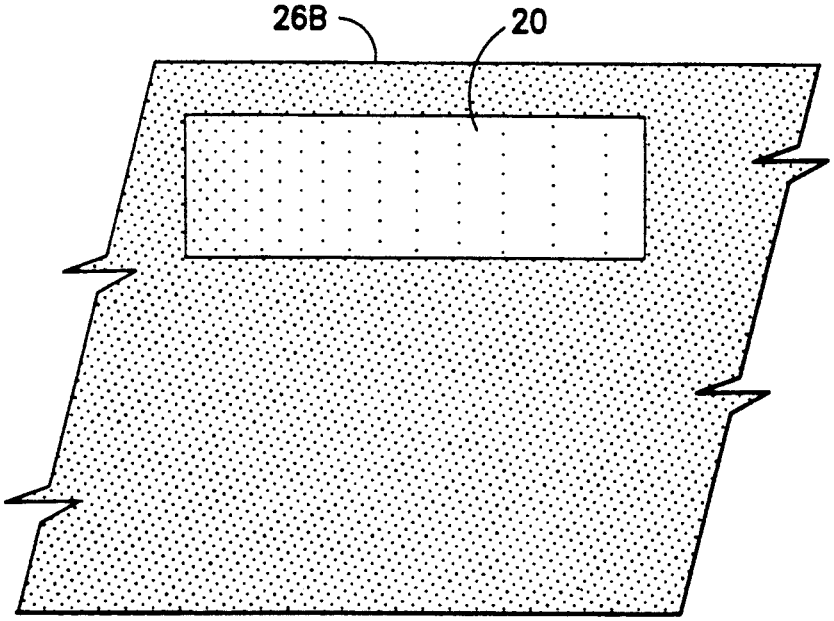
FIG. 4 is a diagrammatic view of a coated fabric in which the conductive coating has been selectively but gradually removed along a strip, thereby forming a conductive coating which forms a conductivity gradient in the direction of the strip.
Figure 4A:
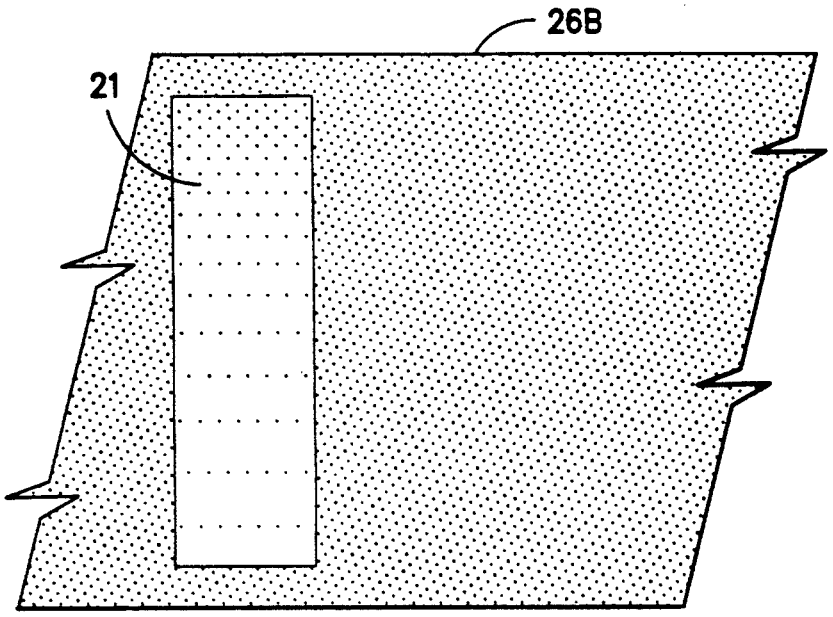
FIG. 4A shows a fabric in which a strip similar to that of FIG. 4 extends across the width of the fabric.

FIGS. 4 and 4A depict fabrics 26B in which the conductive polymer coating has been displaced on the fabric respective in areas 20,21 in the form of a continuous gradient, i.e., the amount of coating removal is varied gradually from one end of the strip to the other by controlling the extent or duration of treatment. The extent of coating removal may be linear, or may be in accordance with a mathematical function, e.g., quadratic, step function, etc. If fabrics 26B are woven fabrics with initially isotropic conductivity characteristics and the coating has been removed in accordance with a gradient pattern using high velocity water streams as disclosed herein, then the electrical conductivity within respective areas 20,21 will change with the direction of measurement due to the direction-preferential coating displacement characteristics discussed above. The conductivity reduction will be highest in the direction parallel to the direction of treatment. Additionally, the "per square" conductivity will also change gradually in the direction of treatment within respective areas 20,21. In FIG. 4, the "per square" conductivity gradient is shown extending along the length of the fabric web, whereas in FIG. 4A, the "per square" gradient is depicted as extending across the width of the fabric web.

Figure 5:
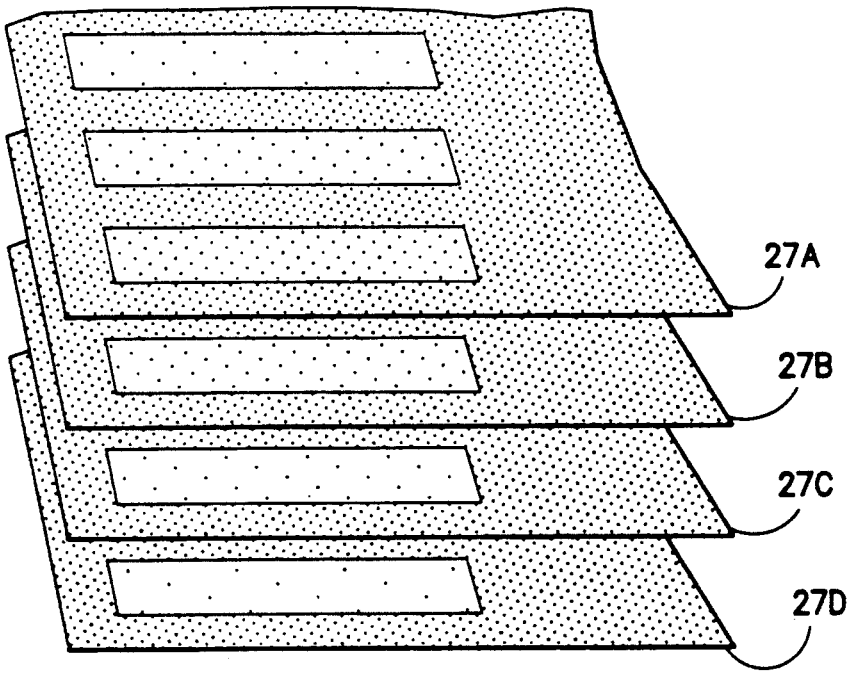
FIG. 5 is a diagrammatic view of a composite structure comprised of several layers of fabric, each of which has been coated with the conductive coating disclosed herein, and each of which has had various portions of that coating removed to form a non-uniform conductive coating.

FIG. 5 depicts a composite arrangement comprised of a plurality of individual sections of coated fabric 27A, 27B, 27C, and 27D, each of which carries a series of strips in which the electrically conductive polymer has been at least partially removed. As shown, the degree to which the polymer is removed may vary in the same relative area on different levels of the composite, resulting in a conductivity gradient which, as depicted, extends vertically through the various layers of fabric. It is contemplated that the individually displaced areas can be either vertically aligned, as shown, or unaligned, depending upon the intended application. It is also contemplated that any suitable individual pattern, such as, for example, the patterns depicted in FIGS. 1 through 4A, may be placed on some or all of the individual layers comprising the composite structure of FIG. 5. Accordingly, conductivity gradients which extend in two or three directions are contemplated. It should be noted that the various sections of fabric 27 A–D need not be individually cut, but could be different portions of the same continuous web, which web has been wrapped or layered about a form. As discussed above, the individually treated areas may be aligned or unaligned.

Figure 5A:
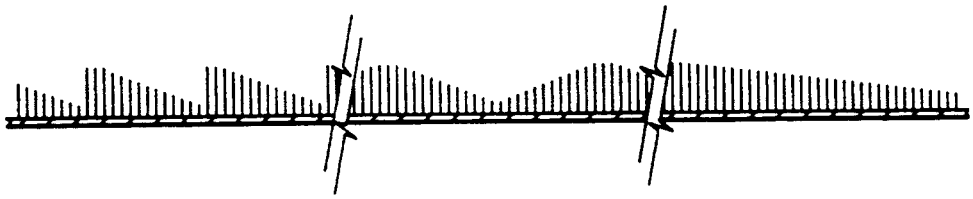
FIG. 5A is a side view of various sections of a pile textile substrate where the pile, coated with a conductive polymer, has been non-uniformly sheared, resulting in a substrate which exhibits non-uniform electrical conductivity perpendicular to the substrate base.

FIG. 5A shows a pile fabric or carpet in which the conductive coating has been applied to both the pile and the base. The pile height has then been varied, as by shearing or other appropriate method, to remove both pile yarns and their conductive coating. The result is a substrate which exhibits a vertical conductivity gradient.

FIGS. 6A and 7A are optical photomicrographs showing the yarns comprising a woven textile fabric which has been coated with the conductive polymer disclosed herein, as seen at 70× magnification. Individual filaments of warp yarns are shown extending out of the page. As best seen in FIGS. 6B and 6C, almost all individual warp yarns show a heavy dark outline, which is believed to be the conductive polymeric coating. The coating completely covers the perimeter of most of the individual warp yarn filaments. The coating is believed to coat and surround large portions of the circumference of those filaments, and to form an electrically conductive path, perhaps along the entire length of some individual filaments. The close physical proximity of partially coated filaments is thought to promote electrical conduction between coated portions of continuous adjacent filaments. FIGS. 7B and 7C, show a portion of the same fabric of FIG. 6, but which has been treated, in the warp direction, with the high velocity water treatment disclosed. It is clear that many of the individual filaments comprising the warp yarns have been partially stripped of their coating of the conductive polymer coating, with the result that these yarns are less conductive along their length than those yarns in which the coating has been undisturbed. Warp filaments on the surface of the yarn bundle appear to have little or no remaining coating. The coating on the warp filaments near the center of the yarn bundle has been displaced and perhaps removed, but not to the same degree. Some portions of the perimeter of the individual filaments near the center of the yarn bundle have been stripped of the conductive polymer, while the coating remains in other areas of the same filament. The overall effect is to decrease the conductivity of the fabric in the warp direction.

Looking at corresponding photomicrographs of the fill yarns, as shown in FIGS. 8A, 8B, and 8C (untreated) and FIGS. 9A, 9B, and 9C (treated), the degree to which the treatment is able to strip the polymer coating from the individual yarn filaments is substantially less than in the warp yarn case. As shown, the filaments comprising the fill yarns are relatively unaffected by exposure to the high velocity water jets, and remain substantially coated by the conductive polymer, at least near the perimeter of the fill yarn bundle.

Similar conclusions are reached if, rather than inspecting the "end-on" cross-sections of FIGS. 6 through 9, the filament profiles shown near the bottom of the lower power photomicrographs are used for comparison.

A consequence of this selective removal of the coating in woven fabrics (i.e., primarily from yarns and filaments which extend parallel to the direction in which the fabric is passed through the high velocity water jet) is that the resulting fabric exhibits electrical conductivity which is directional, i.e., is anisotropic, and which favors conduction in the fill direction (assuming the fabric was initially isotropic and has been subjected to high velocity water treatment while moving in the warp direction). Therefore, a woven fabric treated in accordance with the teachings herein can be made to be relatively electrically conductive (e.g., twenty ohms or less) in the fill direction while, in the same area, exhibiting an electrical conductivity substantially higher (e.g., several tens of thousand ohms) in the warp direction.

As discussed further below, the water jet process used to produce this nonuniformly conductive woven fabric can also be used on fabric having other constructions, for example, knitted or non-woven fabrics. However, when fabrics other than woven fabrics are used, the coating removal process results in fabrics exhibiting substantially isotropic electrical resistance or impedance within a given uniformly treated area. To achieve overall amisotropic conductivity using these fabrics, the fabric must either carry a pattern in which the conductive polymer is removed to a greater or lesser extent within a given treated area (e.g., as shown in FIGS. 4 and 4A), or the treated area must be in the form of a pattern which results in the desired average conductivity characteristics (as in FIGS. 1-3). This can be achieved by selective removal of the coating in a desired pattern configuration, either by water jet treatment, sculpturing techniques, or other appropriate means.

It can therefore be appreciated that the invention disclosed herein may be used on any suitable fabric, regardless of construction, to form one or more conductive paths over the fabric's surface. As discussed previously, woven fabrics are described in terms of "warp" and "fill". The "warp" direction is the direction of the yarns in all woven fabrics that runs lengthwise and parallel to the selvage and is interwoven with the filling. The "fill" direction in woven fabrics is the yarn running from selvage to selvage at right angles to the warp. A yarn is composed of fibers. A knit fabric comprises of a interlocking series of loops of one or more yarns. A yarn is composed of fibers. There are two major types of knitting. There is warp knitting in which the yarns generally run lengthwise in the fabric. The yarns are prepared on beams with one or more yarns for each needle. Examples of this type of knitting are tricot, milanese, and raschel knitting. The other type of knitting is weft knitting in which one continuous thread runs crosswise in the fabric making all the loops in one course. Examples of weft knitting are circular and flat knitting. Knitting is described in terms of "wales" and "courses". A "wale" is defined as a column of loops of yarn lying lengthwise in the fabric and a "wale" direction is the direction of the columns of loops of yarns lying lengthwise in the fabric. The number of wales per inch is a measure of fineness in the fabric. A "wale" corresponds to the term "warp" in knitted fabric. For both woven and knitted fabrics, these terms refer to the yarns that run lengthwise in the fabric and when this disclosure refers to the two directions of the fabric, this is to be considered one of them. The term "course" for knitted fabrics corresponds to the term "fill" in woven fabrics and describes the row of loops or stitches running across a knit fabric and a "course" direction is the direction of the row of loops or stitches running across the fabric. This is considered the second direction of the fabric. A nonwoven fabric is defined as an assembly of textile fibers held together by mechanical interlocking in a random web or mat, by fusing of the fibers (in the case of thermoplastic fibers), or by bonding with a cementing medium such as starch, glue, casein, rubber, latex, or one of the cellulose derivatives or synthetic resins. Initially, the fibers may be oriented in one direction or may be deposited in a random manner. This web or sheet is bonded together by one of the methods described above. One of the two directions of this fabric is that of a "vertical" direction which corresponds to the "warp" direction in woven fabrics and to the "wale" direction in knit fabrics. This "vertical" direction also runs lengthwise in the fabric. The remaining direction is that of a "horizontal" direction which corresponds to the "fill" direction in woven fabrics and to the "course" direction in knit fabrics. This "horizontal" direction also runs crosswise in the fabric. It is respectfully believed that the Applicant's invention is applicable to amy type of fabric.

If non-uniformity (i.e., dependent upon the direction of current flow) is desired in other than woven fabrics, that characteristic is preferably achieved through choice of pattern or severity of treatment (e.g., water velocity, residence time under the jet, etc.). As explained above, woven fabrics may possess a resistance or impedance directionality as a consequence of their construction, as well as by treatment using water jets. When such fabric variations are combined with choice of pattern, and/or severity of treatment, it is possible to produce a wide variety of fabrics having rather complex resistance or impedance characteristics.

The following discussion will address the preferred method by which the coating is displaced selectively in a pattern configuration to form a woven fabric having nonuniform and anisotropic electrical conductivity characteristics. None of the methods or compositions disclosed for generating a conductive coating are intended to be a part of the invention claimed herein.

The process for generating the conductive coating used herein, which process is more completely discussed in U.S. Pat. No. 4,803,096 to Kuhn, et al., involves the substrate being treated with the polymerizable compound and oxidizing agent at relatively dilute concentrations and under conditions which do not result in either the monomer or the oxidizing agent being taken up, whether by adsorption, impregnation, absorption, or otherwise, by the preformed fabric (or the fibers, filaments or yarns forming the fabric). Rather, the polymerizable monomer and oxidizing reagent will first react with each other to form a "pre-polymer" species, the exact nature of which has not yet been fully ascertained, but which may be a water-soluble or dispersible free radical-ion of the compound, or a water-soluble or dispersible dimer or oligomer of the polymerizable compound, or some other unidentified "pre-polymer" species. In any case, it is the "pre-polymer" species, i.e. the in status nascendi forming polymer, which is epitaxially deposited onto the surface of the individual fibers or filaments, as such, or as a component of yarn or preformed fabric or other textile material. Thus, process conditions, such as reaction temperature, concentration of reactants and textile material, and other process conditions are controlled so as to result in epitaxial deposition of the prepolymer particles being formed in the in status nascendi phase, that is, as they are being formed. This results in a very uniform film being formed at the surface of individual fibers or filaments without any significant formation of polymer in solution and also results in optimum usage of the polymerizable compound so that even with a relatively low amount of pyrrole or aniline applied to the surface of the textile, nonetheless a relatively high amount of conductivity is capable of being achieved.

As mentioned briefly above it is the in status nascendi forming compound that is epitaxially deposited onto the surface of the textile material. As used herein the phrase "epitaxially deposited" means deposition of a uniform, smooth, coherent and "ordered" film. This epitaxial deposition phenomenon may be said to be related to, or a species of, the more conventionally understood adsorption phenomenon. While the adsorption phenomenon is not necessarily a well known phenomenon in terms of textile finishing operations it certainly has been known that monomeric materials may be adsorbed to many substrates including textile fabrics. The adsorption of polymeric materials from the liquid phase onto a solid surface is a phenomenon which is known, to some extent, especially in the field of biological chemistry. For example, reference is made to U.S. Pat. No. 3,909,195 to Machell, et al. and U.S. Pat. No. 3,950,589 to Togo, et al. which show methods for treating textile fibers with polymerizable compositions, although not in the context of electrically conductive fibers.

Epitaxial deposition of the in status nascendi forming pre-polymer of either pyrrole or aniline is caused to occur, by, among other factors, controlling the type and concentration of polymerizable compound in the aqueous reaction medium. If the concentration of polymerizable compound (relative to the textile material and/or aqueous phase) is too high, polymerization may occur virtually instantaneously both in solution and on the surface of the textile material and a black powder, e.g. "black polypyrrole", will be formed and settle on the bottom of the reaction flask. If, however, the concentration of polymerizable compound, in the aqueous phase and relative to the textile material, is maintained at relatively low levels, for instance, depending on the particular oxidizing agent, from about 0.01 to about 5 grams of polymerizable compound per 50 grams of textile material in one liter of aqueous solution, preferably from about 1.5 to about 2.5 grams polymerizable compound per 50 grams textile per liter, polymerization occurs at a sufficiently slow rate, and the pre-polymer species will be epitaxially deposited onto the textile material before polymerization is completed. Reaction rates may be further controlled by variations in other reaction conditions such as reaction temperatures, etc. and other additives. This rate is, in fact, sufficiently slow that it may take several minutes, for example 2 to 5 minutes or longer, until a significant change in the appearance of the reaction solution is observed. If a textile material is present in this in status nascendi forming solution of pre-polymer, the forming species, while still in solution, or in colloidal suspension will be epitaxially deposited onto the surface of the textile material and a uniformly coated textile material having a thin, coherent, and ordered conductive polymer film on its surface will be obtained.

In general, the amount of textile material per liter of aqueous liquor may be from about 1 to 5 to 1 to 50 preferably from about 1 to 10 to about 1 to 20.

Controlling the rate of the in status nascendi forming polymer deposition epitaxially on the surface of the fibers in the textile material is not only of importance for controlling the reaction conditions to optimize yield and proper formation of the polymer on the surface of the individual fiber but foremost influences the molecular weight and order of the epitaxially deposited polymer. Higher molecular weight and higher order in electrically conductive polymers imparts higher conductivity and most importantly higher stability to these products.

Pyrrole is the preferred pyrrole monomer, both in terms of the conductivity of the doped polypyrrole films and for its reactivity. However, other pyrrole monomers, including N-methylpyrrole, 3-methylpyrrole, 3,5-dimethylpyrrole, 2,2-bipyrrole, and the like, especially N-methylpyrrole can also be used. More generally, the pyrrole compound may be selected from pyrrole, 3-, and 3,4-alkyl and aryl substituted pyrrole, and N-alkyl, and N-aryl pyrrole. In addition, two or more pyrrole monomers can be used to form conductive copolymer, especially those containing predominantly pyrrole, especially at least 50 mole percent, preferably at least 70 mole percent, and especially preferably at least 90 mole percent of pyrrole. In fact, the addition of a pyrrole derivative as comonomer having a lower polymerization reaction rate than pyrrole may be used to effectively lower the overall polymerization rate. Use of other pyrrole monomers, is, however, not preferred, particularly when especially low resistivity is desired, for example, below about 1,000 ohms per square.

In addition to pyrrole compounds, it has been found that aniline under proper conditions can form a conductive film on the surface of textiles much like the pyrrole compounds mentioned above. Aniline is a very desirable monomer to be used in this expitaxial deposition of an in status nascendi forming polymer, not only for its low cost, but also because of the excellent stability of the conductive polyaniline formed.

Any of the known oxidizing agents for promoting the polymerization of polymerizable monomers may be used in this invention, including, for example, the chemical oxidants and the chemical compounds containing a metal ion which is capable of changing its valence, which compounds are capable, during the polymerization of the polymerizable compound, of providing electrically conductive polymers, including those listed in U.S. Pat. Nos. 4,604,427 to Roberts, et al., 4,521,450 to Bjorklund, et al. and 4,617,228 to Newman, et al.

Specifically, suitable chemical oxidants include, for instance, compounds of polyvalent metal ions, such as, for example, $FeCl_3$, $Fe^2(SO_4)^3$, $K_3(Fe(CN)^6)$, $H_3PO^40.12MoO_3H^3PO_40.12WO^3$, $CrO_3$, $(NH^4)_2Ce(NO^3)_6$, $CuCl^2$, $AgNO_3$, etc., especially $FeCl^3$, and compounds not containing polyvalent metal compounds, such as nitrites, quinones, peroxides, peracids, persulfates, perborates, permanganates, perchlorates, chromates, and the like. Examples of such non-metallic type of oxidants include, for example, $HNO_3$, 1,4-benzoquinone, tetrachloro-1,4-benzoquinone, hydrogen peroxide, peroxyacetic acid, peroxybenzoic acid, 3-chloroperoxybenzoic acid, ammonium persulfate, ammonium perborate, etc. The alkali metal salts, such as sodium, potassium or lithium salts of these compounds, can also be used.

In the case of aniline, as is true with pyrrole, a great number of oxidants may be suitable for the production of conductive fabrics, this is not necessarily the case for aniline. Aniline is known to polymerize to form at least five different forms of polyaniline, most of which are not conductive. At the present time the emeraldine form of polyaniline as described by Wu-Song Huang, et al., is the preferred species of polyaniline. As the name implies, the color of this species of polyaniline is green in contrast to the black color of polypyrrole. With regard to aniline the concentration in the aqueous solution may be from about 0.02 to 10 grams per liter. Aniline compounds that may be employed include in addition to aniline per se, various substituted anilines such as halogen substituted, e.g. chloro-or bromo-substituted, as well as alkyl or aryl-substituted anilines.

The suitable chemical oxidants for the polymerization include persulfates, particular ammonium persulfate, but conductive textiles could also be obtained with ferric chloride. Other oxidants form polyaniline films on the surface of the fibers such as, for instance, potassium dichromate and others.

When employing one of these non-metallic chemical oxidants for promoting the polymerization of the polymerizable compound, it is also preferred to include a "doping" agent or counter ion since it is only the doped polymer film that is conductive. For these polymers, anionic counter ions, such as iodine chloride and perchlorate, provided by, for example, $I^2$, HCl, $HClO_4$, and their salts and so on, can be used. Other suitable anionic counter ions include, for example, sulfate, bisulfate, sulfonate, sulfonic acid, fluoroborate, $PF^{6-}$, $AsF^{6-}$, and $SbF^{6-}$ and can be derived from the free acids, or soluble salts of such acids, including inorganic and organic acids and salts thereof. Furthermore, as is well known, certain oxidants, such as ferric chloride, ferric perchlorate, cupric fluoroborate, and others, can provide the oxidant function and also supply the anionic counter ion. However, if the oxidizing agent is itself an anionic counter ion it may be desirable to use one or more other doping agents in conjunction with the oxidizing agent.

Especially good conductivity can be achieved using sulfonic acid derivatives as the counter ion dopant for the polymers. For example, mention can be made of the aliphatic and aromatic sulfonic acids, substituted aromatic and aliphatic sulfonic acids as well as polymeric sulfonic acids such as poly (vinylsulfonic acid) or poly (styrenesulfonic acid). The aromatic sulfonic acids, such as, for example, benzenesulfonic acid, para-toluenesulfonic acid p-chlorobenzenesulfonic acid and naphthalenedisulfonic acid, are preferred. When these sulfonic acid compounds are used in conjunction with, for example, hydrogen peroxide, or one of the other non-metallic chemical oxidants, in addition to high conductivity of the resulting polymer films, there is a further advantage that the reaction can be carried out in conventional stainless steel vessels. In contrast, $FeCl_3$ oxidant is highly corrosive to stainless steel and requires glass or other expensive specialty metal vessels or lined vessels. Moreover, the peroxides, persulfates, etc. have higher oxidizing potential than $FeCl^3$ and can increase the rate of polymerization of the compound.

Generally, the amount of oxidant is a controlling factor in the polymerization rate and the total amount of oxidant should be at least equimolar to the amount of the monomer. However, it may be useful to use a higher or lower amount of the chemical oxidant to control the rate of polymerization or to assure effective utilization of the polymerizable monomer. On the other hand, where the chemical oxidant also provides the counter ion dopant, such as in the case with $FeCl_3$, the amount of oxidant may be substantially greater, for example, a molar ratio of oxidant to polymerizable compound of from about 4:1 to about 1:1, preferably 3:1 to 2:1.

Within the amounts of polymerizable compound and oxidizing agent as described above, the conductive polymer is formed on the fabric in amounts corresponding to about to about 4%, preferably about 1.0% to about 3%, especially preferably about 1.5% to 2.5%, such as about 2%, by weight based on the weight of the fabric. Thus, for example, for a fabric weighing 100 grams a polymer film of about 2 gm may typically be formed on the fabric.

Furthermore, the rate of polymerization of the polymerizable compound can be controlled by variations of the pH of the aqueous reaction mixture. While solutions of ferric chloride are inherently acidic, increased acidity can be conveniently provided by acids such as HCl or $H^2SO_4$; or acidity can be provided by the doping agent or counter ion, such as benzenesulfonic acid and its derivatives and the like. It has been found that pH conditions from about five to about one provide sufficient acidity to allow the in status nascendi epitaxial adsorption of the polymerizable compound to proceed. Preferred conditions, however, are encountered at a pH of from about three to about one.

Another important factor in controlling the rate of polymerization (and hence formation of the prepolymer adsorbed species) is the reaction temperature. As is generally the case with chemical reactions, the polymerization rate will increase with increasing temperature and will decrease with decreasing temperature. For practical reasons it is convenient to operate at or near ambient temperature, such as from about 10° C. to 30° C., preferably from about 18° C. to 25° C. At temperatures higher than about 30° C., for instance at about 40° C. or higher, the polymerization rate becomes too high and exceeds the rate of epitaxial deposition of the in status nascendi forming polymer and also results in production of unwanted oxidation by-products. At temperatures below about 10° C., the polymerization rate becomes slower but a higher degree of order and therefore better conductivities can be obtained. The polymerization of the polymerizable compound can be performed at temperatures as low as about 0° C. (the freezing temperature of the aqueous reaction media) or even lower where freezing point depressants, such as various electrolytes, including the metallic compound oxidants and doping agents, are present in the reaction system. The polymerization reaction must, of course, take place at a temperature above the freezing point of the aqueous reaction medium so that the prepolymer species can be epitaxially deposited onto the textile material from the aqueous reaction medium.

Yet another controllable factor which has significance with regard to the process of the present invention is the rate of deposition of the in status nascendi forming polymer on the textile material. The rate of deposition of the polymer to the textile fabric should be such that the in status nascendi forming polymer is taken out of solution and deposited onto the textile fabric as quickly as it is formed. If, in this regard, the polymer or pre-polymer species is allowed to remain in solution too long, its molecular weight may become so high that it may not be efficiently deposited but, instead, will form a black powder which will precipitate to the bottom of the reaction medium.

The rate of epitaxial deposition onto the textile fabric depends, inter alia, upon the concentration of the species being deposited and also depends to some degree on the physical and other surface characteristics of the textile material being treated. The rate of deposition, furthermore, does not necessarily increase as concentrations of the polymeric or pre-polymer material in the solution increase. On the contrary, the rate of epitaxial deposition of the in status nascendi forming polymer material to a solid substrate in a liquid may actually increase as concentration of the material increases to a maximum and then as the concentration of the material increases further the rate of epitaxial deposition may actually decrease as the interaction of the material with itself to make higher molecular weight materials becomes the controlling factor.

Deposition rates and polymerization rates may be influenced by still other factors. For instance, the presence of surface active agents or other monomeric or polymeric materials in the reaction medium may interfere with and/or slow down the polymerization rate. It has been observed, for example, that the presence of even small quantities of nonionic and cationic surface active agents almost completely inhibit formation on the textile material of the electrically conductive polymer whereas anionic surfactants, in small quantities, do not interfere with film formation or may even promote formation of the electrically conductive polymer film. With regard to deposition rate, the addition of electrolytes, such as sodium chloride, calcium chloride, etc. may enhance the rate of deposition.

The deposition rate also depends on the driving force of the difference between the concentration of the adsorbed species on the surface of the textile material and the concentration of the species in the liquid phase exposed to the textile material. This difference in concentration and the deposition rate also depend on such factors as the available surface area of the textile material exposed to the liquid phase and the rate of replenishment of the in status nascendi forming polymer in the vicinity of the surfaces of the textile material available for deposition.

Therefore, it follows that best results in forming uniform coherent conductive polymer films on the textile material are achieved by continuously agitating the reaction system in which the textile material is in contact during the entire polymerization reaction. Such agitation can be provided by simply shaking or vibrating or tumbling the reaction vessel in which the textile material is immersed in the liquid reactant system or alternatively, the liquid reactant system can be caused to flow through and/or across the textile material.

As an example of this later mode of operation, it is feasible to force the liquid reaction system over and through a spool or bobbin of wound textile filaments, fibers (e.g. spun fibers), yarn or fabrics, the degree of force applied to the liquid being dependent on the winding density, a more tightly wound and thicker product requiring a greater force to penetrate through the textile and uniformly contact the entire surface of all of the fibers or filaments or yarn. Conversely, for a loosely wound or thinner yarn or filament package, correspondingly less force need be applied to the liquid to cause uniform contact and deposition. In either case, the liquid can be recirculated to the textile material as is customary in many types of textile treating processes. Yarn packages up to 10 inches in diameter have been treated by the process of this invention to provide uniform, coherent, smooth polymer films. The observation that no particulate matter is present in the coated conductive yarn package provides further evidence that it is not the polymer particles, per se—which are water-insoluble and which, if present, would be filtered out of the liquid by the yarn package—that are being deposited onto the textile material.

As an indication that the polymerization parameters, such as reactant concentrations, temperature, and so on, are being properly maintained, such that the rate of epitaxial deposition of the in status nascendi forming polymer is sufficiently high that polymer does not accumulate in the aqueous liquid phase, the liquid phase should remain clear or at least substantially free of particles visible to the naked eye throughout the polymerization reaction. Yields of pyrrole polymer, for instance, based on pyrrole monomer, of greater than 50%, especially greater than 75%, can be achieved.

When the process disclosed herein is applied to textile fibers, filaments or yarns directly, whether by the above-described method for treating a wound product, or by simply passing the textile material through a bath of the liquid reactant system until a coherent uniform conductive polymer film is formed, or by any other suitable technique, the resulting composite electrically conductive fibers, filaments, yarns, etc. remain highly flexible and can be subjected to any of the conventional knitting, weaving or similar techniques for forming fabric materials of any desired shape or configuration, without impairing the electrical conductivity.

Furthermore, the rate of oxidative polymerization can be effectively controlled to a sufficiently low rate to obtain desirably ordered polymer films of high molecular weight to achieve increased stability, for instance against oxidative degradation in air. Thus, as described above, reaction rates can be lowered by lowering the reaction temperature, by lowering reactant concentrations (e.g. using less polymerizable compound, or more liquid, or more fabric), by using different oxidizing agents, by increasing the pH, or by incorporating additives in the reaction system.

While the precise identity of the adsorbing species has not been identified with any specificity, certain theories or mechanisms have been advanced although the invention is not to be considered to be limited to such theories or proposed mechanisms. It has thus been suggested that in the chemical or electrochemical polymerization, the monomer goes through a cationic, free radical ion stage and it is possible that this species is the species which is adsorbed to the surface of the textile fabric. Alternatively, it may be possible that oligomers or pre-polymers of the monomers are the species which are deposited onto the surface of the textile fabric. In the case of the oxidative polymerization of aniline a similar mechanism to the polymerization of pyrrole may occur. It is believed that in the case of polyaniline formation, a free radical ion is also formed as a prepolymer and may be the species which is actually adsorbed.

In any event, if the rate of deposition is controlled as described above, it can be seen by microscopic investigation that a uniform and coherent film of polymer is deposited onto the surface of the textile material. Analyzing this film, by dissolving the fibers of the textile fabric from under the composite, washing the residual polymer with additional solvent and then examining the resulting array with a light microscope, shows that the film is actually in the form of burst tubes, thus evidencing the uniformity of the formed electrically conductive film. Surprisingly, each film or fragment of film is quite uniform. The films are either transparent or semi-transparent because the films are, in general, quite thin and one can directly conclude from the intensity of the color observed under the microscope the relative thickness of the film. In this regard, it has been calculated that film thickness may range from about 0.05 to about 2 microns, preferably from 0.1 to about 1 micron. Further, microscopic examination of the films show that the surface of the films is quite smooth. This is quite surprising when one contrasts these films to polypyrrole formed electrochemically or chemically, wherein, typically, discrete particles may be found within or among the polymeric films.

A wide variety of textile materials may be employed, for example, fibers, filaments, yarns and various fabrics made therefrom. Such fabrics may be woven or knitted fabrics and are preferably based on synthetic fibers, filaments or yarns. In addition, even non-woven structures, such as felts or similar materials, may be employed. Preferably, the polymer should be epitaxially deposited onto the entire surface of the textile. This result may be achieved, for instance, by the use of a relatively loosely woven or knitted fabric but, by contrast, may be relatively difficult to achieve if, for instance, a highly twisted thick yarn were to be used in the fabrication of the textile fabric. The penetration of the reaction medium through the entire textile material is, furthermore, enhanced if, for instance, the fibers used in the process are texturized textile fibers.

Fabrics prepared from spun fiber yarns as well as continuous filament yarns may be employed. In order to obtain optimum conductivity of a textile fabric, however, it may be desirable to use continuous filament yarns so that a film structure suitable for the conducting of electricity runs virtually continuously over the entire surface of the fabric. In this regard, it has been observed, as would be expected, that fabrics produced from spun fibers processed according to the present invention typically show somewhat less conductivity than fabrics produced from continuous filament yarns.

A wide variety of synthetic fibers may be used to make the textile fabrics of the present invention. Thus, for instance, fabric made from synthetic yarn, such as polyester, nylon and acrylic yarns, may be conveniently employed. Blends of synthetic and natural fibers may also be used, for example, blends with cotton, wool and other natural fibers may be employed. The preferred fibers are polyester, e.g. polyethylene terephthalate including cationic dyeable polyester and polyamides, e.g. nylon, such as Nylon 6, Nylon 6,6, and so on. Another category of preferred fibers are the high modulus fibers such as aromatic polyester, aromatic polyamide and polybenzimidazole. Still another category of fibers that may be advantageously employed include high modulus inorganic fibers such as glass and ceramic fibers. Although it has not been clearly established, it is believed that the sulfonate groups or amide groups present on these polymers may function as a "built-in" doping agent.

Conductivity measurements have been made on the fabrics which have been prepared according to the method of the present invention. Standard test methods are available in the textile industry and, in particular, AATCC test method 76-1982 is available and has been used for the purpose of measuring the resistivity of textile fabrics. According to this method, two parallel electrodes 2 inches long are contacted with the fabric and placed 1 inch apart. Resistivity may then be measured with a standard ohm meter capable of measuring values between 1 ohm and 20 million ohms. Measurements must then be multiplied by 2 in order to obtain resistivity in ohms on a per square basis. While conditioning of the samples may ordinarily be required to specific relative humidity levels, it has been found that conditioning of the samples made according to the present invention is not necessary since conductivity measurements do not vary significantly at different humidity levels. The measurements reported in the following example are, however, conducted in a room which is set to a temperature of 70° F. and 50% relative humidity. Resistivity measurements are reported herein and in the examples in ohms per square (/sq) and under these conditions the corresponding conductivity is one divided by resistivity.

In general, fabrics treated according to the teachings herein show resistivities of below $10^6$ ohms per square, such as in the range of from about 20 to 500,000 ohms per square, preferably from about 500 to 5,000 ohms per square. These sheet resistivities can be converted to volume resistivities by taking into consideration the weight and thickness of the polymer films. Some samples tested after aging for several months do not significantly change with regard to resistivity during that period of time. In addition, samples heated in an oven to 380° F. for about one minute also show no significant loss of conductivity under these conditions. These results indicate that the stability of the conductive film made on the surface of textile materials is excellent, indicating a higher molecular weight and a higher degree of order than usually obtained by the chemical oxidation of these monomers.

Various procedures can be used to perform the method of preparation of a conductive fabric as it applies to the invention by operating within the parameters as described above. Typical methods are described below:

Method A

Approximately 50 g of fabric is placed in a dyeing machine having a rotating basket insert and the port of the machine is closed. Depending upon the desirable liquid ratio, usually about 500 cc, water is then added to the reaction chamber. The basket is turned to assure that the fabric is properly wetted out before any other ingredients are added. Then the desired amount and type of oxidizing agent is dissolved in approximately 500 cc of water and is added to the machine while the basket is rotating. Finally, the monomer and if necessary the doping agent in approximately 500 cc of water is added through the addition tank to the rotating mixture. In order to eliminate any heat build-up during the rotation, cooling water is turned on so that the temperature of the bath is kept at the temperature of the cooling water, usually between 20° and 30° C. After the fabric has been exposed for the appropriate length of time, the bath is dropped and replaced with water; in this way the fabric is rinsed twice. The fabric is then withdrawn and air dried.

Method B

An 8 ounce jar is charged with five to ten grams of the fabric to be treated. Generally, approximately 150 cc of total liquor are used in the following manner: First, approximately 50 cc of water is added to the jar and the jar is closed and the fabric is properly wetted out with the initial water charge. The oxidizing agent is then added in approximately 50 cc of water, the jar is closed and shaken again to obtain an appropriate mixture. Then the monomer and if necessary the doping agent in 50 cc of water is added at once to the jar. The jar is first shaken by hand for a short period of time and then is put in a rotating clamp and rotated at approximately 60 RPM for the appropriate length of time. The fabric is withdrawn, rinsed and air dried as described for Method A. Conveniently this method can be used to conduct the reaction at room temperature or if preferred at lower temperatures. If lower temperatures are used the mixture including the fabric and oxidizing agent is first immersed into a constant temperature bath such as a mixture of ice and water and rotated in such a bath until the temperature of the mixture has assumed the temperature of the bath. Concurrently the monomer and if necessary the doping agent in water is also precooled to the temperature at which the experiment is to be conducted. The two mixtures are then combined and the experiment is continued, rotating the reaction mixture in the constant temperature bath.

Method C

A one-half gallon jar is charged with 50–100 g of fabric to which usually a total of 1.5 liter of reaction mixture is added in the following manner: First, 500 cc of water are added to the jar and the fabric is properly wetted out by shaking. Then the oxidizing agent dissolved in approximately 500 cc of water is added and mixed with the original charge of water. Subsequently, the monomer and if necessary the doping agent in 500 cc of water is added at once to the jar. The jar is closed and set in a shaking machine for the appropriate length of time. The fabric is withdrawn from the jar and washed with water and air dried.

Method D

A glass tube approximately 3 cm in diameter and 25 cm long equipped with a removable top and bottom connection is charged with approximately 5 to 10 g of fabric which has been carefully rolled up to fill approximately 20 cm of the length of the tube. A mixture containing approximately 150 cc of reaction mixture is prepared by dissolving the oxidizing agent in approximately 100 cc of water and then adding at once to the solution a mixture of the monomer and if necessary the doping agent in approximately 50 cc of water. The resulting mixture of oxidizing agent and monomer is pumped into the glass tube through the bottom inlet by the use of a peristaltic pump, e.g. from Cole Palmer. As soon as the entire amount is inside the glass tube, the pump is momentarily stopped and the hose through which the liquor has been sucked out of the container is connected to the top outlet of the reaction chamber. The flow is then reversed and the pumping action continues for the desired amount of time. After this, the tube is emptied and the fabric is withdrawn from the tube and rinsed in tap water.

In Method D the glass tube can be jacketed and the reaction can be run at temperatures which can be varied according to the temperature of the circulating mixture in the jacket.

These methods describe a number of possible modes by which this reaction can be carried out.

Unless otherwise indicated, all parts and percentages are by weight, and a reported conductivity measurements are in the warp direction and fill directions, respectively, unless otherwise noted.

EXAMPLE 1

Following the procedure described for Method A, 50 grams of a polyester fabric consisting of a 2×2 right hand twill, weighing approximately 6.6 oz. per square yard and being constructed from a 2/150/34 textured polyester yarn from Celanese Type 667 (fabric construction is such that approximately 70 ends are in the warp direction and 55 picks are in the fill direction), is placed in a Werner Mathis JF dyeing machine using 16.7 g ferric chloride hexahydrate, 2 g of pyrrole, 1.5 g of 37% hydrochloric acid in a total of 1.5 liters of water. The treatment is conducted at room temperature conditions for two hours. The resulting fabric has a dark gray, metallic color and a resistivity of 3,000 and 4,000 ohms per square in the warp and fill directions, respectively.

EXAMPLE 2

Example 1 is repeated except that the fabric is made from basic dyeable polyester made from DuPont's Dacron 92T is used in the same construction as described in Example 1. The resistivity on the fabric measures 2,000 ohms per square in the warp direction and 2,700 ohms per square in the fill direction. This example demonstrates that the presence of anionic sulfonic acid groups, as they are present in the basic dyeable polyester fabric, apparently enhances the adsorption of the polymerizing species to the fabric, resulting in a higher conductivity.

EXAMPLE 3

Example 1 is repeated except that 50 g of nylon fabric, constructed from an untextured continuous filament of Nylon 6, as described in Style #322 by Test Fabrics, Inc. of Middlesex, N.J. 08846 is used. The black appearing fabric showed a resistivity of 7,000 and 12,000 ohms per square in the warp and fill direction, respectively.

EXAMPLE 4

Seven grams of textured Nylon 6,6 fabric, Style #314 from Test Fabrics, Inc. is treated according to the procedure of Method B using a total of 150 cc of liquor, using 1 g of ferric chloride anhydride, 0.15 g of concentrated hydrochloric acid and 0.2 g of pyrrole. After spinning the flask for two hours, a uniformly treated fabric is obtained showing a resistivity of 1,500 and 2,000 ohms per square in the two directions of the fabric.

EXAMPLE 5

Fifty grams of a bleached, mercerized cotton fabric from Test Fabrics, Inc., Style #429, is treated according to Method A using 10 g of ferric chloride anhydride, 1.5 g of concentrated hydrochloric acid, and 2 g of pyrrole. A uniformly treated fabric of dark black color is obtained with resistivities of 71,000 ohms and 86,000 ohms per square, respectively, in the two directions of fabric.

EXAMPLE 6

Fifty grams of a spun Orlon sweater knit fabric from Test Fabrics, Inc., Style #860, is treated according to Method C, using 10 g of ferric chloride anhydride, 1.5 g of concentrated hydrochloric acid and 2 g of pyrrole. After two hours of shaking, the fabric is withdrawn, washed and dried and shows a resistivity of 7,000 and 86,000 ohms per square in the two directions of the fabric.

EXAMPLE 7

Approximately 50 g of a wool flannel fabric from Test Fabrics, Inc. Style #527, is treated according to Method C using the same chemicals in the same amounts as described in Example 6. After washing and drying, the so prepared wool fabric shows a uniform black color and has a resistivity of 22,000 and 18,000 ohms per square in the two directions of the fabric.

EXAMPLE 8

Approximately 50 g of a fabric produced from a spun viscose yarn, Style #266, from Test Fabrics, Inc. was treated by Method C in the same manner as described in Example 6. After drying, the fabric shows a uniform black color and has a resistivity of 130,000 and 82,000 ohms per square in the two directions of the fabric.

EXAMPLE 9

Approximately 50 g of a fabric produced from a spun Nylon 6,6 yarn from Test Fabrics, Inc. Style #361, was treated according to Method A, using the same chemicals and amounts as described in Example 6. After reacting the fabric for two hours and washing and drying, the spun nylon fabric shows a uniform black color and has a resistivity of 2,400 and 6,000 ohms per square, respectively, in the two directions of the fabric.

EXAMPLE 10

Fifty grams of a fabric produced from a spun polypropylene yarn from Test Fabrics, Inc. Style #976, is treated according to Method A, using the same chemicals and amounts as described in Example 6. After treatment and drying, the so produced polypropylene fabric has a metallic gray color and shows a resistivity of 35,000 and 65,000 ohms per square, respectively, in the two directions of the fabric.

EXAMPLE 11

Approximately 50 g of a fabric produced from a spun polyester yarn from Test Fabrics, Inc. Style #767, is treated according to Method A, using identical chemicals and amounts as described in Example 1. After drying, a uniformly appearing grayish fabric is obtained showing a resistivity of 11,000 and 20,000 ohms per square in the two directions of the fabric.

EXAMPLE 12

Approximately 5 g of an untextured Dacron taffeta fabric from Test Fabrics, Inc. Style #738, is treated according to Method B, as described in Example 4. After treatment, a uniformly grayish looking fabric having resistivity of 920 and 960 ohms per square in the two directions of the fabric is obtained.

EXAMPLE 13

Approximately 5 g of a weft insertion fabric, consisting of a Kevlar warp and a polyester filling, is treated according to Method B, using the same conditions as described in Example 4. The resulting fabric has a resistivity of approximately 1,000 ohms per square in the direction of the Kevlar yarns and 3,500 ohms per square in the direction of the polyester yarns.

EXAMPLE 14

Approximately 5 g of a filament acetate sand crepe fabric, Test Fabrics, Inc. Style #101, is treated according to Method B, under the same conditions as described in Example 4. The resulting fabric has a resistivity of approximately 7,200 and 9,200 ohms per square in the two directions of the fabric.

EXAMPLE 15

Approximately 5 g of a filament acetate Taffeta fabric, Test Fabrics, Inc. Style #111, is treated according to Method B, using the same conditions as described in Example 4. The resulting fabric has a resistivity of approximately 47,000 and 17,000 ohms per square in the two directions of the fabric.

EXAMPLE 16

Approximately 5 g of a filament Rayon Taffeta fabric, Test Fabrics, Inc. Style #213, is treated according to Method B, using the same conditions as described in Example 4. The resulting fabric has a resistivity of approximately 420,000 and 215,000 ohms per square in the two directions of fabric.

EXAMPLE 17

Approximately 5 g of a filament Arnel fabric, Test Fabrics Inc., Style #115, is treated according to Method B, using the same conditions as described in Example 4. The resulting fabric has a resistivity of approximately 6,000 and 10,500 ohms per square in the two directions of the fabric.

The previous examples show the applicability of the coating process to a wide range of synthetic and natural fabrics under a broad range of conditions, including reactant concentrations and contacting methods. The following examples serve to further demonstrate some of the useful parameters for carrying out the coating process.

EXAMPLE 18

Following the procedure of Method A, 50 grams of a polyester fabric, as described in Example 1, is treated at room temperature for two hours in a Werner Mathis JF dyeing machine, using 3.75 g of sodium persulfate, 2 g of pyrrole in a total of 1.5 liter water. The resulting fabric has a resistivity of 39,800 and 57,000 ohms per square in the warp and fill directions, respectively.

When this example is repeated, except that 20 g NaCl is used in the treatment, the resistivity values are decreased to 11,600 ohms and 19,800 ohms per square in the warp and fill directions, respectively.

If in place of 20 g NaCl, 10 g $CaCl^2$ is used and the total amount of water is decreased in 1.0 liter, the resistivity is further lowered to 3,200 ohms per square and 4,600 ohms per square, respectively. These results are comparable to the results obtained in Example 1 using 16.7 g $FeCl_3.6H^2O$ and 1.5 g of 37% HCl.

EXAMPLE 19

This example shows that the conductive polypyrrole films are highly substantive to the fabrics treated according to this invention. The procedure of Example 1 is repeated, except that in place of 16.7 g of $FeCl_3.6H^2O$, 10 g of anhydrous $FeCl_3$ is used. The resulting fabric is washed in a home washing machine and the pyrrole polymer film is not removed, as there is no substantial color change after 5 repeated washings.

EXAMPLE 20

The following example demonstrates the importance of temperature in the epitaxial polymerization of pyrrole. Following the procedure for low temperature reaction given in Method B, 5 grams of polyester fabric as defined in Example 1 was treated using 1.7 gram of ferric chloride hexahydrate, 0.2 grams of pyrrole, 0.5 grams of 2,6-naphthalenedisulfonic acid, disodium salt in 150 cc of water at 0° C. After tumbling the sample for 4 hours the textile material was withdrawn and washed with water. After drying a resistivity of 100 ohms and 140 ohms was obtained in the two directions of the fabric.

EXAMPLE 21

The same experiment was repeated but instead of the polyester fabric, 7 grams of a knitted, textured nylon fabric (test fabric S/314) was used. After rinsing and drying resistivities of 130 and 180 ohms respectively were obtained in the two directions of the fabric.

EXAMPLE 22

This example illustrates a modification of the procedure of Method A described above using ammonium persulfate (APS) as the oxidant wherein the total amount of oxidant is introduced incrementally to the reaction system over the course of the reaction.

Fifty two grams of polyester fabric, as described in Example 1), is placed in the rotating basket insert of a Werner Mathis JF dyeing machine and, with the port of the machine closed, 500 cc of water is added to the reaction chamber to wet out the fabric. Then 1.7 g APS and 5 g of 1,5-naphthalenedisulfonic acid, disodium salt, dissolved in 500 cc of water is introduced to the reaction chamber while the basket is rotating. Finally, 2 g pyrrole in 500 cc water is added to the rotating mixture and the reaction is allowed to proceed at about 20° C. for 30 minutes, at which time an an additional 1.7 g APS (in 50 cc $H_2O$) is introduced to the rotating reaction mixture. After 60 minutes and 90 minutes from the initiation of the reaction (i.e. from the introduction of the pyrrole monomer) an additional 1.7 g APS in 50 cc water is introduced to the reactor, such that a total of 6.8 g APS ($1.7\times4$) is used. The reaction is halted at the end of two hours (30 minutes after last introduction of APS) by dropping the bath and rinsing twice with water. The fabric is withdrawn from the reactor and is air dried. The pH of the liquid phase at the end of the reaction is 2.5. The resistivity of the fabric is 1,000 ohms per square and 1,200 ohms per square in the warp and fill directions, respectively. Visual observation of the liquid phase at the end of the reaction shows that no polymer particles are present.

EXAMPLE 23

Following the procedure in Method B, 7 g of textured nylon fabric, test fabric style 314 is inserted into an 8 oz. jar containing 150 cc of water, 0.4 g of aniline hydrochloride, 1 g conc. HCl, 1 g of 2,6-naphthalenedisulfonic acid, disodium salt and 0.7 g of ammonium persulfate. After rotating the flask for 2 hours at room temperature a uniformly treated fabric having the typical green color of the emeraldine version of poly-aniline is obtained showing a resistivity of 4200 ohms and 5200 ohms in the two directions of the knitted fabric.

EXAMPLE 24

The above experiment is repeated except that the reaction vessel is immersed in an ice water mixture to conduct the reaction at 0° C. A green colored fabric is obtained showing a resistivity of 6400 ohms and 9000 ohms in the two directions of the fabric.

EXAMPLE 25

Example 31 was repeated using 5 g of polyester fabric as defined in Example #1. A resistivity of 75000 and 96600 ohms was measured in the two directions of the fabric.

EXAMPLE 26

The same experiment as in Example 31 was repeated but 9 g of basic dyeable polyester, as defined in example #2, was used. A resistivity of 15800 and 11800 ohms was measured in the two directions of the fabric.

EXAMPLE 27

Following the procedure in Method B, 7 grams of textured nylon fabric, test fabrics Style 314, is inserted into an 8 ounce jar containing 75 cc of water 0.4 gram of aniline hydrochloride, 5 grams of concentrated HCl, 1 gram of 1,3-benzenedisulfonic acid disodium salt and 0.7 gram of ammonium persulfate. After rotating the flask for 4 hours at room temperature, a uniformly treated fabric having a green color was obtained, showing a resistivity of 1500 ohms and 2000 ohms in the two directions of the knitted fabric. This example demonstrates how variations in concentration and acidity can lead to improved and higher conductive fabrics.

EXAMPLE 28

Approximately 50 g of fabric (S205 polyester) is treated with 12.5 g of pyrrole in 500 cc of water, added over a time period of one hour, by Method A. 181 g of 39% iron chloride solution is used as the oxidizing agent and 800 g of 1,5 napthalenedisulfonic acid is used as the dopant. The reaction is allowed to proceed for one hour after the last of the pyrrole has been added. The fabric is rinsed in tap water and air dried at ambient temperature. Resistance measurements were made in accordance with the method described in the Kuhn patent and found to be approximately 7 ohms in the warp direction and 6 ohms in the fill direction. The total resistance being 13 ohms/sq.

EXAMPLE 29

Approximately 65 g of fabric (S205 polyester) is immersed in a solution of 6.9 g of aniline, 166 g of ptoluenesulfonic acid and 0.26 g of sodium metavanadate in 1015 cc of water. The mixture is cooled to 5° C. and treated over a time period of three hours with a solution of 9.7 g of ammonium persulfate in 73.5 cc of water as described in Method A. About three hours after addition of the oxidant the fabric is heated without rinsing at 100° C. for twenty minutes. Resistance measurements were made in accordance with the method described hereinabove and found to be approximately 14 ohms in the warp direction and 12 ohms in the fill direction.

FIG. 10 depicts an overall view of an apparatus, invented by others, which may be used to remove the coatings disclosed above. This apparatus uses a combination manifold/stream forming/stream interrupting apparatus 50, which is depicted in more detail in FIGS. 12 through 17. Pump 8 is used to pump, via suitable conduits 4, 10, a working fluid such as water from a suitable source of supply 2 through an appropriate filter 6 to a high pressure supply duct 52, which in turn supplies water at suitable dynamic pressure (e.g., between 300 p.s.i.g. and 3,000 p.s.i.g.) to the manifold apparatus 50. Also depicted in FIG. 11 are the conduits 136 for directing the control fluid, for example, slightly pressurized air as supplied from source 130, and valves 134 by which the flow of control fluid may be selectively established or interrupted in response to pattern information supplied by pattern data source 132. As will be explained in greater detail hereinbelow, establishing the flow of control fluid to manifold apparatus 50 via conduits 136, pressurized no higher than approximately one-twentieth of the pressure of the high velocity water, causes an interruption in the flow of high velocity water emanating from manifold apparatus 50 and striking the substrate placed against backing member 21. Conversely, interrupting such control fluid flow causes the flow of high velocity water to impact the substrate 26 placed against backing member 21.

Looking to FIG. 11, it may be seen that manifold assembly 50 is comprised of five basic structures: high pressure supply gallery assembly 60 (which is mounted in operable association with high pressure supply duct 52), grooved chamber assembly 70, clamping assembly 90, control fluid conduits 136, and spaced barrier plate assembly 100.

Supply gallery assembly 60 is comprised of an "L"-shaped member, into one leg of which is machined a uniform notch 62 which extends, uninterrupted, along the entire length of the assembly 50. A series of uniformly spaced supply passages 64 are drilled through the side wall 66 of assembly 60 to the corresponding side wall of notch 62, whereby notch 62 may be supplied with high pressure water from high pressure supply duct 52, the side of which may be appropriately milled, drilled, and connected to side wall 66 and the end of respective supply passages 64. Slotted chamber assembly 70 is comprised of an elongate member having an inverted hook-shaped cross-section, and having an extending leg 72 into which have been machined a series of closely spaced parallel slots or grooves 74 each having a width approximately equal to the width of the desired high velocity treatment stream, and, associated with each slot, a series of communicating control fluid passages, shown in greater detail in FIGS. 12 through 16. These control passages are connected to control fluid conduits 136, through which is supplied a flow of low pressure control fluid during those intervals in which the flow of high pressure fluid flowing through slots 74 is to be interrupted.

As shown in FIGS. 13 through 16, the control fluid passages are comprised of a pair of slot intercept passages 76 spaced along the base of each slot and connected to an individual elongate chamber 78 which is aligned with the axis of its respective slot 74. Each slot 74 has associated with it a respective chamber 78, which in turn is connected, via respective individual control supply passages 80, to a respective control fluid conduit 136. In practice, chambers 78 may be made by drilling a passage of the desired length from the barrier plate (104) side of chamber assembly 70, then plugging the exit hole in a manner appropriate to contain the relatively low pressure control fluid.

Grooved chamber assembly 70 is positioned, via clamping assembly 90, within supply gallery assembly 60 so that its "C"-shaped chamber is facing notch 62, thereby forming a high pressure distribution reservoir chamber 84 in which, as depicted in FIGS. 14 and 15, high pressure water enters notch 62 via passages 64, enters reservoir chamber 84, and flows through slots 74 towards the substrate 26. Clamping assembly 90 is provided along its length with jacking screws 92 as well as bolts 94 which serve to securely attach clamping assembly 90 to supply gallery assembly 60 along the side opposite barrier plate assembly 100. It is important to note that the configuration and placement of slotted chamber assembly 70 provides for slots 74 to be entirely covered over the portion of slots closest to reservoir chamber 84, but provides for slots 74 to be uncovered or open over the portion of slots nearest barrier plate assembly 100, and particularly over that portion of the slots 74 opposite and immediately downstream of slot intercept passages 76.

Associated with supply gallery assembly 60 and attached thereto via tapered spacing supports 102 is spaced barrier plate assembly 100, comprising a rigid plate 104 having an edge which is positioned to be just outside the path of the high velocity stream as the stream leaves the confines of slot 74 and exits from the end of chamber assembly 70, and crosses the plane defined by plate 104. To ensure rigidity of plate 104, elongate backing plate 103 is securely attached to the inside surface of plate 104, via screws 105 positioned along the length of plate 104. Screws 106, which thread into threaded holes in spacing supports 102, are used to fix the position of plate 104 following alignment adjustment via threaded alignment bolts 108. Bolts 108 are associated with alignment guide 110 which is, at the time of machine set up, attached to the base of supply gallery assembly 60 via screws 112. By turning bolts 108, precise and reproducible changes in the relative elevation of plate 104, and thereby the clearance between the distal or upstanding edge of plate 104 and the path of the high velocity fluid jet(s), may be made. After the plate 104 is brought into satisfactory alignment relative to slots 74, screws 106 may be tightened and alignment guide 110, with bolts 108, may be removed, thereby fixing the edge of plate 104 in proper relation to the base of slots 74.

FIG. 13 depicts a fluid jet(s) impacting the substrate 26 perpendicular to the plane of tangency to the surface of support roll 21 at the point of impact; in some cases, however, it may be advantageous to direct the fluid jet(s) at a small angle relative to such plane, in either direction (i.e., either into or along the direction of rotation of roll 21). Generally, such angles (hereinafter referred to as "inclination angles") are about twenty degrees or less, but may be more for some applications. As depicted in FIG. 13, when no control fluid is flowing through conduit 136 and slot intercept passages 76, highly pressurized water from passages 64 fills high pressure reservoir chamber 84 and is ejected towards substrate 26, via slots 74, in the form of a high velocity stream which passes in close proximity to the distal or upstanding edge of barrier plate 104. The high velocity streams are formed as the high pressure water is forced through the passages formed by covered portions of slots 74; the streams retain substantially the same cross section as they travel along the uncovered portion of slots 74 between supply gallery assembly 60 and barrier plate 104, diverging only slightly as they leave the confines of the slots 74, pass the upstanding portion of barrier plate 104, and strike the substrate 26.

As depicted in FIGS. 14 and 15, when a "no treatment" signal is sent to a valve controlling the flow of control fluid in a given conduit 136, a relatively low pressure control fluid, e.g., air, is made to flow from the selected conduit 136 into the associated slot intercept passages 76 of a given slot 74, and the high velocity stream traveling along that slot is subjected to a force directed to the open side of the slot 74. Absent a counteracting force, this relatively slight pressure introduced by the control fluid causes the selected high velocity stream to leave the confines of the slot 74 and strike the barrier plate rather than the substrate, where its energy is dissipated, leaving the substrate untouched by the energetic stream. In a preferred embodiment of the apparatus, a separate electrically actuated air valve such as the Tomita Tom-Boy JC-300, manufactured by Tomita Co., Ltd., No. 18-16 1 Chome, Ohmorinaka, Ohta-ku, Tokyo, Japan, is associated with each control stream conduit. A valve actuating signal may be generated by conventional computer means, i.e., via an EPROM or from magnetic media, and routed to the respective valves, whereby the high velocity treatment streams may be selectively and intermittently actuated in accordance with supplied pattern data.

FIG. 16 is a section view taken through lines XVI-XVI of FIG. 15, and diagrammatically indicates the effects of control fluid flow in conduits 136. As indicated, low pressure control fluid is flowing in control stream conduits 136 identified as "A" and "C", while no control fluid is flowing in conduits 136 identified as "B" and "D". In conduits "A" and "C", the high velocity jets 120A and 120C, respectively, have been dislodged from the lateral walls of slots 74 and are being deflected on a trajectory which will terminate on the inner surface of barrier plate 104. In contrast, no control fluid is flowing in conduits 136 identified as "B" and "D"; as a consequence, the high velocity jets 120B and 120D, laterally defined by the walls of slots 74, are on a trajectory which will avoid the upstanding edge of barrier plate 104 and terminate on the surface of roll 21, or substrate 26 supported thereby.

EXAMPLE 30

A fabric made electrically conductive by treatment using the reaction conditions of Method A described hereinabove in conjunction with conventional dyeing techniques is treated after drying by the water jet method described hereinabove. The fabric is passed through the machine at a constant speed of 3 yds./min. at a gap of 0.036 in. and a 5° angle. The fluid used is air and three separate runs are made at pressures of 900, 1000, and 1100 psi. The resistance of the treated areas are measured at 1.5 inch intervals by the method described in the Kuhn patent. The resistance varied from 293 ohms/sq. to 774 ohms/sq. for the 900 psi setting, 291 ohms/sq. to 1506 ohms/sq. for the 1000 psi setting, and 298 ohms/sq. to 2341 ohms/sq. for the 1100 psi setting.

While the above-described apparatus is preferred for removing the coatings herein on woven fabrics due to the difference in coating removal between warp and fill yarns, it is not intended that high velocity water jets be the only way electrical conductivity gradients or electrically anisotropic areas are generated to form the fabrics of this invention. For example, shearing of the yarns carrying the electrically conductive coating may be used to decrease the amount of coating present on the fabric and thereby increase the resistance of the fabric in the sheared area.

That which is claimed is:

1. A method for generating a conductive woven fabric which exhibits anisotropic electrical conductivity, said method comprising a. coating a substantially non-conductive fabric with an electrically conductive coating b. selectively removing at least portions of said coating in selected areas of said fabric using high velocity jets of water.

2. The method of claim 1 wherein said woven fabric is comprised of fibers extending in the warp direction and fibers extending in the fill direction, and wherein said coating is preferentially removed from said fibers extending in the warp direction.

3. The method of claim 1 wherein said woven fabric is comprised of fibers extending in the warp direction and fibers extending in the fill direction, and wherein said coating is preferentially removed from said fibers extending in the fill direction.

4. The method of claim 2 wherein said coating is essentially comprised of doped polypyrrole.

5. The method of claim 3 wherein said coating is essentially comprised of doped polyaniline.

6. The product of the process of claim 1.

7. The product of the process of claim 2.

8. The product of the process of claim 3.

9. The product of the process of claim 4.

10. The product of the process of claim 5.

11. A method for generating a conductive knitted fabric which exhibits anisotropic electric conductivity, said method comprising a. coating a substantially non-conductive fabric with an electrically conductive coating b. selectively removing at least portions of said coating in selected areas of said fabric using high velocity jets of water.

12. The method of claim 11 wherein said knitted fabric is comprised of fibers extending in the wale direction and fibers extending in the course direction, and wherein said coating is preferentially removed from said fibers extending in the wale direction.

13. The method of claim 11 wherein said knitted fabric is comprised of fibers extending in the wale direction and fibers extending in the course direction, and wherein said coating is preferentially removed from said fibers extending in the course direction.

14. The method of claim 12 wherein said coating is essentially comprised of doped polypyrrole.

15. The method of claim 13 wherein said coating is essentially comprised of doped polyaniline.

16. The product of the process of claim 11.

17. The product of the process of claim 12.

18. The product of the process of claim 13.

19. The product of the process of claim 14.

20. The product of the process of claim 15.

21. A method for generating a conductive nonwoven fabric which exhibits anisotropic electrical conductivity, said method comprising a. coating a substantially non-conductive fabric with an electrically conductive coating b. selectively removing at least portions of said coating in selected areas of said fabric using high velocity jets of water.

22. The method of claim 21 wherein said nonwoven fabric is comprised of fibers extending in the vertical direction and fibers extending in the horizontal direction, and wherein said coating is preferentially removed from said fibers extending in the vertical direction.

23. The method of claim 21 wherein said nonwoven fabric is comprised of fibers extending in the vertical direction and fibers extending in the horizontal direction, and wherein said coating is preferentially removed from said fibers extending the horizontal direction.

24. The method of claim 22 wherein said coating is essentially comprised of doped polypyrrole.

25. The method of claim 23 wherein said coating is essentially comprised of doped polyaniline.

26. The product of the process of claim 21.

27. The product of the process of claim 22.

28. The product of the process of claim 23.

29. The product of the process of claim 24.

30. The product of the process of claim 25.

* * * * *